US007825885B2

(12) United States Patent
Sato et al.

(10) Patent No.: US 7,825,885 B2
(45) Date of Patent: Nov. 2, 2010

(54) DISPLAY DEVICE

(75) Inventors: Tomohiko Sato, Kanagawa (JP); Naoyuki Itakura, Kanagawa (JP); Takeya Takeuchi, Kanagawa (JP); Tomoyuki Fukano, Kanagawa (JP)

(73) Assignee: Sony Corporation, Tokyo (JP)

( * ) Notice: Subject to any disclaimer, the term of this patent is extended or adjusted under 35 U.S.C. 154(b) by 879 days.

(21) Appl. No.: 11/499,509

(22) Filed: Aug. 3, 2006

(65) Prior Publication Data

US 2007/0188431 A1 Aug. 16, 2007

(30) Foreign Application Priority Data

Aug. 5, 2005 (JP) ..... 2005-228739
Aug. 5, 2005 (JP) ..... 2005-228740
Aug. 12, 2005 (JP) ..... 2005-234826

(51) Int. Cl.
*G09G 3/36* (2006.01)

(52) U.S. Cl. ..... 345/89; 345/100

(58) Field of Classification Search ..... 345/89–90, 345/98, 100
See application file for complete search history.

(56) References Cited

U.S. PATENT DOCUMENTS 5,686,932 A * 11/1997 Tomita ..... 345/94
5,691,740 A * 11/1997 Onitsuka et al. ..... 345/96
5,694,145 A * 12/1997 Kondo et al. ..... 345/90
5,748,169 A * 5/1998 Okumura et al. ..... 345/100
5,781,171 A * 7/1998 Kihara et al. ..... 345/93
5,977,940 A * 11/1999 Akiyama et al. ..... 345/94
6,037,923 A * 3/2000 Suzuki ..... 345/92
6,084,562 A * 7/2000 Onda ..... 345/94
6,404,414 B2 * 6/2002 Ishii ..... 345/90
6,778,163 B2 * 8/2004 Ozawa ..... 345/96
6,864,871 B1 * 3/2005 Okada et al. ..... 345/90
6,873,312 B2 * 3/2005 Matsueda ..... 345/98
2004/0263495 A1 * 12/2004 Sugino et al. ..... 345/204
2005/0035805 A1 * 2/2005 Tanada ..... 327/291

FOREIGN PATENT DOCUMENTS

JP 03-012633 1/1991
JP 04-107525 4/1992

(Continued)

*Primary Examiner*—Chanh Nguyen
*Assistant Examiner*—Jonathan Blancha
(74) *Attorney, Agent, or Firm*—Robert J. Depke; Rocky, Depke & Lyons, LLC

(57) ABSTRACT

A display device having a pixel section pixel circuits, scan lines, capacity lines, a drive circuit driving the scan lines and the capacity lines selectively, a generation circuit generating a common voltage signal switching in level at a predetermined cycle, and a correction circuit correcting the signals driving the capacity lines of the drive circuit, wherein each pixel circuit contains a display element and holding capacitor, a first pixel electrode of the display element pixel cell, a first electrode of the holding capacitor, and one terminal of the switching element are connected, a second electrode of the holding capacitor is connected to the capacity lines arrayed in a corresponding row, and the common voltage signal is applied in a second pixel electrode of the display element. The correction circuit has a monitor circuit monitoring the pixel potential of the pixel section and correcting a signal driving the capacity lines taking into consideration the optical characteristics of the display element based on the monitor result of the monitor circuit.

3 Claims, 27 Drawing Sheets

1

FOREIGN PATENT DOCUMENTS

| | | |
|---|---|---|
| JP | 05-094153 | 4/1993 |
| JP | 05-241124 | 9/1993 |
| JP | 07-230075 | 8/1995 |
| JP | 11-119746 | 4/1999 |
| JP | 2000-298459 | 10/2000 |
| JP | 2002-311914 | 10/2002 |
| JP | 2005-17941 | 1/2005 |

* cited by examiner

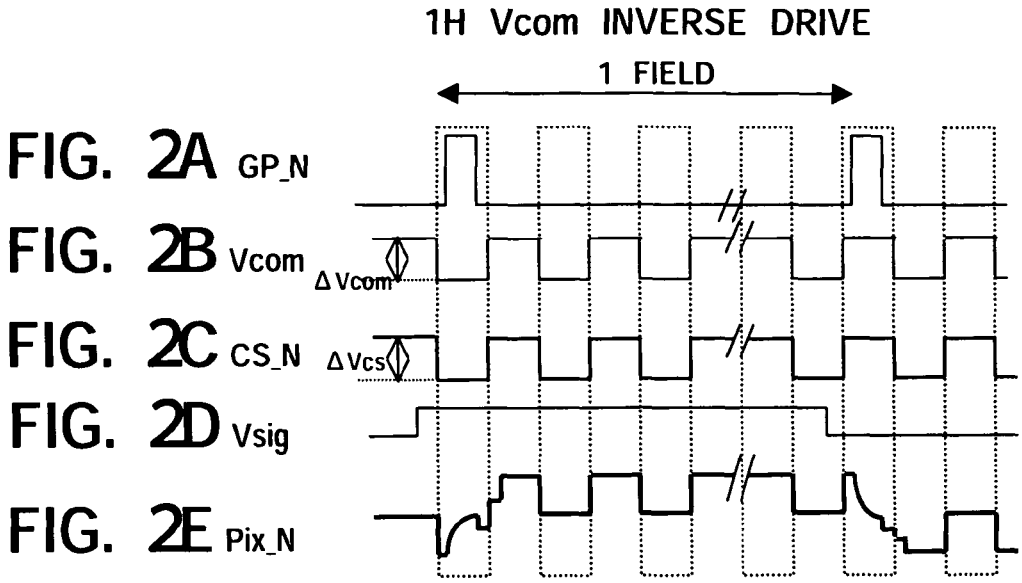
FIG. 3
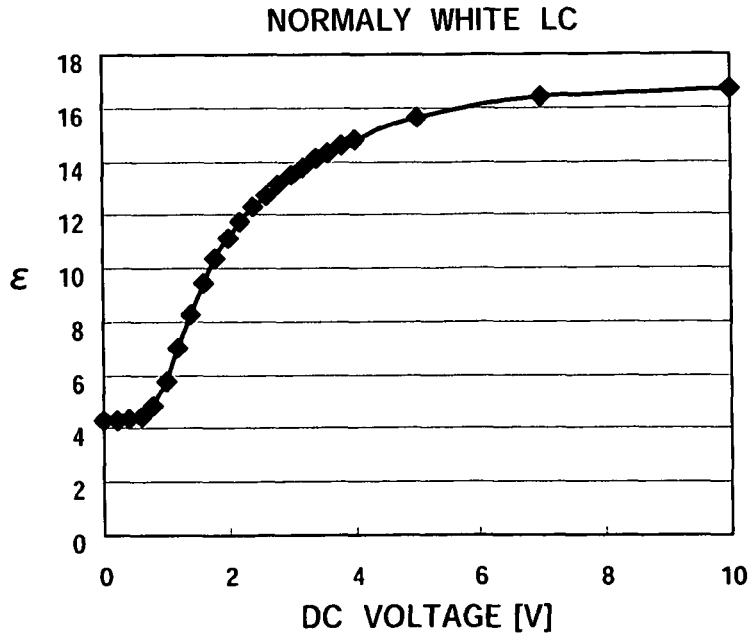

FIG. 9A LSCS
FIG. 9B Gate DT
FIG. 9C GP1
FIG. 9D GP2
FIG. 9E GP3
FIG. 9F GP4
FIG. 9G GP5
FIG. 9H CS_DT
FIG. 9I CS_1
FIG. 9J CS_2
FIG. 9K CS_3
FIG. 9L CS_4

FIG. 15A VCK
FIG. 15B ENB
FIG. 15C POL
FIG. 15D VSRout_n-1
FIG. 15E GP_n-1
FIG. 15F Cs_n-1
FIG. 15G VSRout_n
FIG. 15H GP_n
FIG. 15I Cs_n
FIG. 15J VSRout_n+1
FIG. 15K GP_n+1
FIG. 15L Cs_n+1

FIG. 20
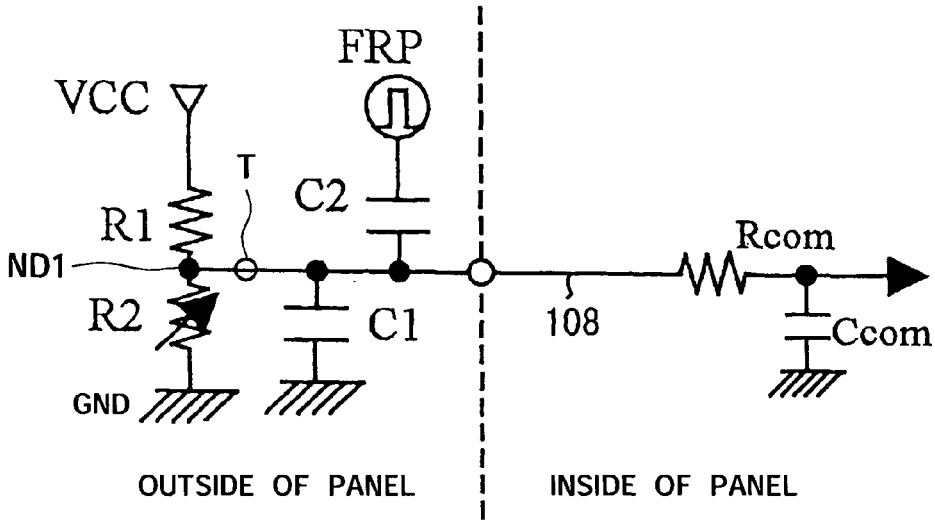
FIG. 21A GP_N
FIG. 21B Vcom
FIG. 21C CS_N
FIG. 21D Vsig
FIG. 21E Pix_N
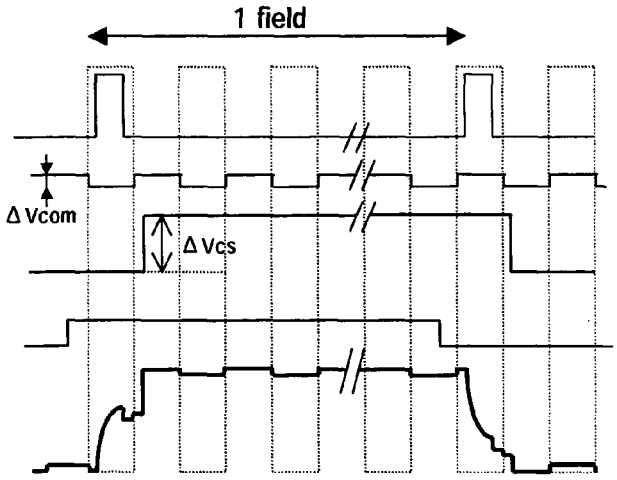

TEMPERATURE DEPENDENCY OF SUITABLE Vcs
Vcs [V]
4.5
4.0
3.5
3.0
2.5
2.0
1.5
1.0
0.5
0.0
-40°C
-20°C
0°C
20°C
40°C
60°C
80°C
TEMPERATURE [°C]
TRANSFORM TO Vp(ε + η) = F (⊿Vpε)

TEMPERATURE DEPENDENCY OF SUITABLE Vcs
CONSIDER ⊿ε AND ⊿η
HIGH TEMPERATURE REGION
LOW TEMPERATURE REGION
OBTAIN
Vcs (⊿nd + ⊿ε) [V]
2.6
2.8
3.0
3.2
3.4
3.6
3.8
4.0
Vcs (⊿ε)

DISPLAY DEVICE

CROSS REFERENCE TO RELATED APPLICATION

The present invention contains subject matter related to Japanese Patent Applications No. 2005-228739, No. 2005-228740 filed in the Japan Patent Office on Aug. 5, 2005, and No. 2005-234826 filed in the Japan Patent Office on Aug. 12, 2005, the entire contents of which being incorporated herein by reference.

BACKGROUND OF THE INVENTION

1. Field of Invention

The present invention relates to an active matrix-type display device having display elements of pixels (electrooptic elements) arrayed in a display region in a matrix.

2. Description of the Related Art

Display devices, for example, liquid crystal display devices using liquid crystal cells for the display elements of the pixels (electrooptic elements), feature thin profiles and low power consumptions. Utilizing these features, they are being used in, for example, personal digital assistants (PDAs), mobile phones, digital cameras, video cameras, personal computer-use display devices, and other electronic devices.

FIG. 1 is a block diagram showing an example of the configuration of a liquid crystal display device (for example, see Japanese Patent Publication (A) No. 11-119746 and Japanese Patent Publication (A) No. 2000-298459). The liquid crystal display device 1, as shown in FIG. 1, has an effective pixel section 2, a vertical drive circuit (VDRV) 3, and a horizontal drive circuit (HDRV) 4.

The effective pixel section 2 having a plurality of pixel circuits 21 arrayed in a matrix. Each pixel circuit 21 is configured by a thin film transistor (TFT) as a switching element, a liquid crystal cell LC with a pixel electrode connected to the drain electrode of the TFT (or source electrode), and a storage capacitor Cs with one electrode connected to the drain electrode of the TFT. For these pixel circuits 21, scan lines (gate lines) 5-1 to **5-*m* are arranged along the pixel array direction and signal lines 6-1 to 6-*n* are arranged along the pixel array direction. Further, gate electrodes of the TFTs of the pixel circuit 21 are connected in row units to the identical scan lines 5-1 to 5*m*. Further, the source electrodes of the pixel circuits 21 (or drain electrodes) are connected in column units to the identical signal lines 6-1 to 6-*n***.

Further, in a general liquid crystal display device, a storage (holding) capacitor line is arranged independently. Storage (holding) capacitors Cs are formed between the storage capacitor line and first electrodes of the liquid crystal cells LC. The storage capacitor line receives a pulse in-phase with the common voltage VCOM and is used as a storage (holding) capacitor as well. In a general liquid crystal display device, the storage capacitors Cs of all pixel circuits 21 in the effective pixel section 2 are connected in common to one storage capacitor line. Further, the second electrodes of the liquid crystal cells LC of the pixel circuits 21 are connected in common to, for example, a supply line 7 of the common voltage Vcom inverting in polarity with each horizontal scan period (1H).

The scan lines 5-1 to **5-*m* are driven by the vertical drive circuit 3, while the signal lines 6-1 to 6-*n* are driven by the horizontal drive circuit 4**.

The vertical drive circuit 3 performs a scan in the vertical direction (column direction) at each field period and successively selects pixel circuits 21 connected to the scan lines 5-1 to **5-*m* in row units. For example, when a scan pulse SP1 is given to the scan line 5-1 from the vertical drive circuit 3, pixels of the columns of the first row are selected, while when a scan pulse SP2 is given to the scan line 5-2, the pixels of the columns of the second row are selected. In the same way below, the scan pulses SP3, . . . , SPm are given in sequence to the scan lines 5-3, . . . , 5-*m***.

FIG. 2A to FIG. 2E are timing charts in a so-called 1H Vcom inversion drive system of the general liquid crystal display device shown in FIG. 1.

Further, as another drive system, a capacity coupling drive system using coupling from the storage capacitor line Cs and modulating the voltage applied to the liquid crystals is known (for example, see Japanese Patent Publication (A) No. 2-157815).

The above-explained capacity coupling drive system, in comparison to the 1H Vcom inversion drive system, can improve the response speed of the liquid crystals by so-called overdrive and further can reduce audio noise generated by the Vcom frequency band and perform contrast compensation (optimization) etc. in superhigh definition panels.

SUMMARY OF THE INVENTION

When employing the capacity coupling drive system described in Japanese Patent Publication (A) No. 2-157815 to a liquid crystal display device using a liquid crystal material having the characteristic of the liquid crystal dielectric constant ∈ for the applied voltage such as shown in FIG. 3 (for normally white specifications), there is the drawback of the white luminance becoming black (dropping) when trying to optimize the black luminance as shown in the following equation (1), FIG. 4, and FIG. 5. Due to this, in current liquid crystal display devices employing the capacity coupling drive system, there is the drawback of not being able to simultaneously optimize the black luminance and the white luminance.

$$\Delta Vpix1 = Vsig + \{Ccs/(Ccs+Clc)\} * \Delta Vcs - Vcom \quad (1)$$

In equation (1), Δvpix denotes the effective pixel potential, Vsig denotes the video signal voltage, Ccs denotes a storage capacitor, Clc denotes a liquid crystal capacity, ΔVcs denotes the potential of the signal CS, and Vcom denotes the common voltage. As explained above, when trying to optimize the black luminance, the white luminance drops in the {Ccs/(Ccs+Clc)}*ΔVcs term of equation (1) to allow the nonlinearity of the liquid crystal dielectric constant to influence the effective pixel potential.

It is therefore desireable in the present invention to provide a display device enabling simultaneous optimization of the black luminance and the white luminance.

According to a first embodiment of the invention, there is provided a display device having a pixel section including a plurality of pixel circuits, each writing video pixel data propagated through a switching element over a signal line, arranged in a matrix, a plurality of scan lines arranged so as to correspond to an array of rows of the pixel circuits and control conduction of the switching elements, a plurality of capacity lines arranged so as to correspond to an array of rows of the pixel circuits, a drive circuit for selectively driving the plurality of scan lines and the plurality of capacity lines, a generation circuit for generating a common voltage signal switched in level at a predetermined cycle, and a correction circuit for correcting the signals driving the capacity lines of the drive circuit, wherein each pixel circuit arrayed at the pixel section includes a display element having a first pixel electrode and second pixel electrode and a holding capacitor having a first electrode and second electrode, a first pixel electrode of the display element pixel cell and a first electrode of the holding capacitor are connected to one terminal of the switching element, a second electrode of the holding capacitor is connected to the capacity line arrayed at a corresponding row, a second pixel electrode of the display element is supplied with the common voltage signal, and the correction circuit has a monitor circuit for monitoring the pixel potential of the pixel section and corrects the signals driving the capacity lines considering the optical characteristics of the display elements based on the results of monitoring of the monitor circuit.

Preferably, the common voltage signal is a small amplitude signal.

Preferably, the correction circuit performs weighting in accordance with temperature in the correction.

Preferably, the correction circuit divides the temperature at a predetermined boundary into a high temperature region and low temperature region and performs different weighting in the two regions.

Preferably, the correction circuit divides the temperature at a predetermined boundary into a high temperature region and low temperature region and sets the weighting value of the high temperature region to a value larger than the weighting value of the low temperature region in the correction.

Preferably, the correction circuit performs rough adjustment and fine adjustment in a plurality of frames and selects a desired value.

Preferably, the drive circuit drives the scan lines of the selected row, writes pixel data into the desired pixel circuits, then drives the capacity lines of the same row.

Preferably, the drive circuit selects as a signal for driving a capacity line one of a first level and a second level lower than the first level and applies it to the corresponding capacity line.

Preferably, the pixel circuit has display elements including liquid crystal cells.

According to a second embodiment of the invention, there is provided a display device having a pixel section including a plurality of pixel circuits, each writing video pixel data propagated through a switching element over a signal line, arranged in a matrix, a plurality of scan lines arranged so as to correspond to an array of rows of the pixel circuits and control conduction of the switching elements, a plurality of capacity lines arranged so as to correspond to an array of rows of the pixel circuits, a drive circuit for selectively driving the plurality of scan lines and the plurality of capacity lines, a generation circuit for generating a common voltage signal switched in level at a predetermined cycle, and a correction circuit for correcting the signals driving the capacity lines of the drive circuit, wherein each pixel circuit arrayed at the pixel section includes a display element having a first pixel electrode and second pixel electrode and a holding capacitor having a first electrode and second electrode, a first pixel electrode of the display element pixel cell and a first electrode of the holding capacitor are connected to one terminal of the switching element, a second electrode of the holding capacitor is connected to the capacity line arrayed at a corresponding row, a second pixel electrode of the display element is supplied with the common voltage signal, and the drive circuit has a capacity line driver which drives a corresponding capacity line independently for each row based on a polarity signal at the time of a pixel write operation.

Preferably, the common voltage signal is a small amplitude signal.

Preferably, the drive circuit has a capacity line driver which determines a polarity of a signal driving a capacity line based on the polarity at the time of a pixel write operation.

Preferably, the drive circuit has a scan line driver including a shift register for shifting a predetermined signal in a column direction and a buffer receiving the signal of the shift register and driving the corresponding scan line, and the capacity line driver includes a first latch latching the polarity signal based on an output signal of the shift register to the buffer and a second latch latching and outputting the polarity signal latched by the first latch based on a shift signal to a next stage of the shift register.

Preferably, the drive circuit drives the scan lines of the selected row, writes pixel data into the desired pixel circuits, then drives the capacity lines of the same row.

Preferably, the drive circuit selects as a signal for driving a capacity line one of a first level and a second level lower than the first level and applies it to the corresponding capacity line.

Preferably, the pixel circuit has display elements including liquid crystal cells.

According to a third embodiment of the invention, there is provided a display device having a pixel section having a plurality of pixel circuits, each writing video pixel data propagated through a switching element over a signal line, arranged in a matrix, a plurality of scan lines arranged so as to correspond to an array of rows of the pixel circuits and control conduction of the switching elements, a plurality of capacity lines arranged so as to correspond to an array of rows of the pixel circuits, a first drive circuit for selectively driving the plurality of scan lines and the plurality of capacity lines from first ends, a second drive circuit for selectively driving the plurality of scan lines and a plurality of the capacity lines among the plurality of capacity lines from other ends, and a generation circuit for generating a common voltage signal switched in level at a predetermined cycle, wherein each pixel circuit arrayed at the pixel section includes a display element having a first pixel electrode and second pixel electrode and a holding capacitor having a first electrode and second electrode, a first pixel electrode of the display element pixel cell and a first electrode of the holding capacitor are connected to one terminal of the switching element, a second electrode of the holding capacitor is connected to the capacity line arrayed at a corresponding row, and a second pixel electrode of the display element is supplied with the common voltage signal.

Preferably, the common voltage signal is a small amplitude signal.

Preferably, the first and second drive circuits have capacity line drivers which drive the corresponding capacity lines independently for each row based on the polarity signal at the time of a pixel write operation.

Preferably, the second drive circuit has a capacity line driver which drives corresponding capacity lines in response to a drive signal from the first drive circuit propagated through scan lines of the corresponding row.

Preferably, each of the drive circuits drives the scan lines of the selected row, writes pixel data into the desired pixel circuits, then drives the capacity lines of the same row.

Preferably, each of the drive circuits selects as a signal for driving a capacity line one of a first level and a second level lower than the first level and applies it to the corresponding capacity line.

Preferably, the pixel circuit has display elements including liquid crystal cells.

According to the present invention, there is the advantage to being able to simultaneously optimize the black luminance and the white luminance.

BRIEF DESCRIPTION OF THE DRAWINGS

These and other objects and features of the present invention will become clearer from the following description of the preferred embodiments given with reference to the attached drawings, wherein:

FIGS. 2A to 2E are timing charts in a so-called 1H Vcom inversion drive system of the liquid crystal display device shown in FIG. 1;

FIG. 3 is a graph showing the relation between the dielectric constant and the applied voltage of a normally white liquid crystal;

FIG. 20 is a circuit diagram showing an example of the configuration of a common voltage generation circuit according to the present embodiment;

FIGS. 21A to 21E are timing charts showing drive waveforms of a main liquid crystal cell of the present embodiment;

DESCRIPTION OF THE PREFERRED EMBODIMENTS

Below, embodiments of the present invention will be explained with reference to the figures.

Figure 1:
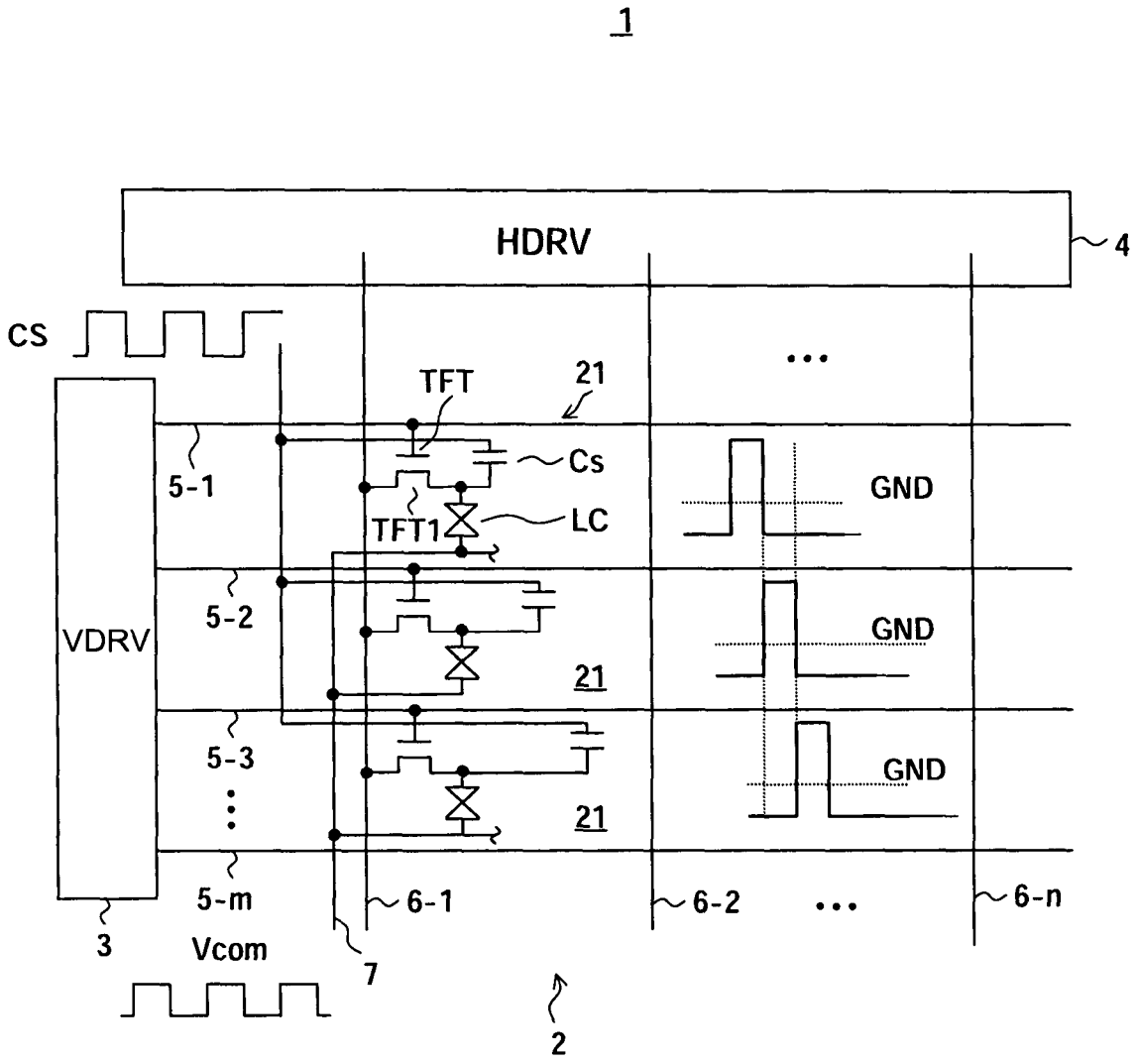
FIG. 1 is a block diagram showing an example of the configuration of a liquid crystal display device.
Figure 4:
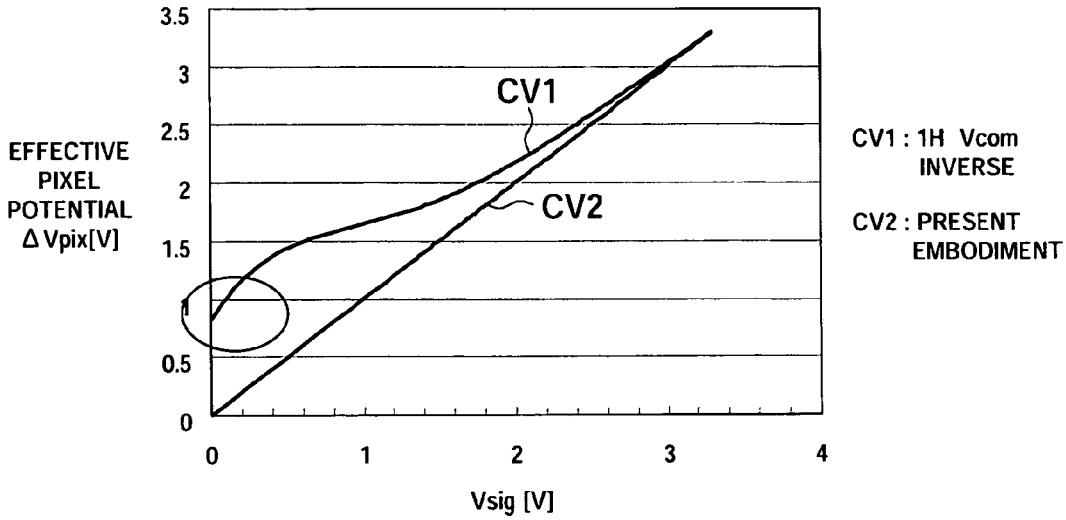
FIG. 4 is a graph showing the relationship between the video signal voltages of liquid crystal display devices employing the 1H Vcom inversion drive system and the related capacity coupling drive system and the effective pixel potential.
Figure 5:
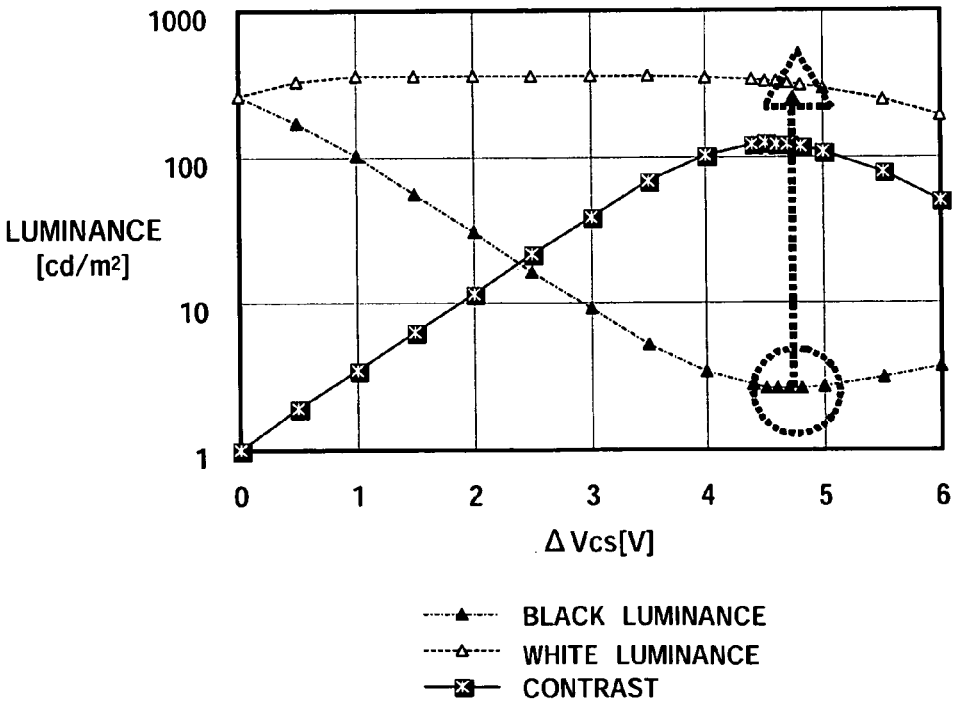
FIG. 5 is a graph showing the blackening (dropping) of the white luminance when optimizing the black luminance of a liquid crystal display device employing the related capacity coupling drive system.
Figure 6:
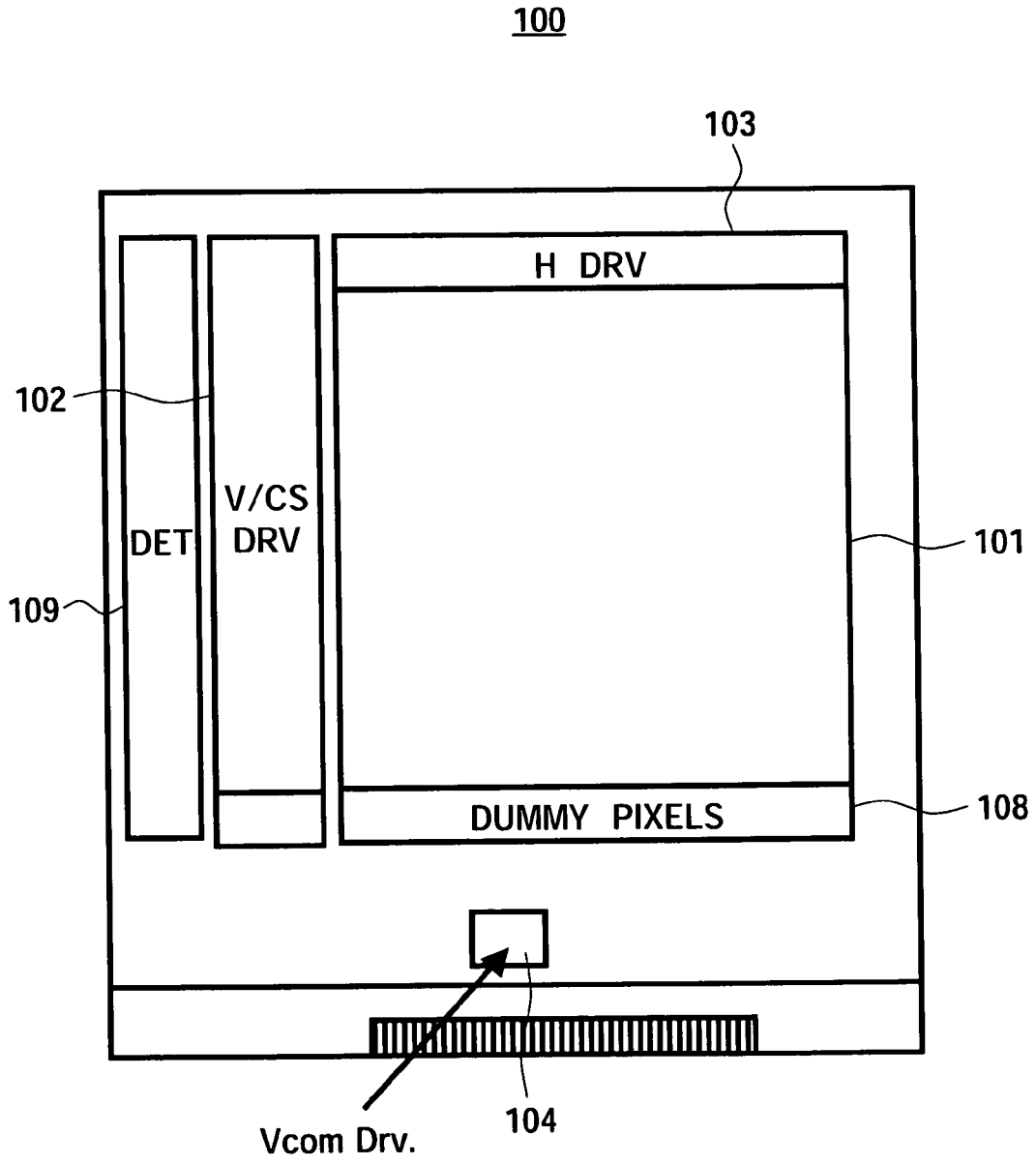
FIG. 6 is a diagram showing an example of the configuration of the active matrix type display device according to an embodiment of the present invention.

FIG. 6 is a view showing an example of the configuration of an active matrix type display device according to a first embodiment of the present invention using for example liquid crystal cells as display elements of pixels (electrooptic elements).

Figure 7:
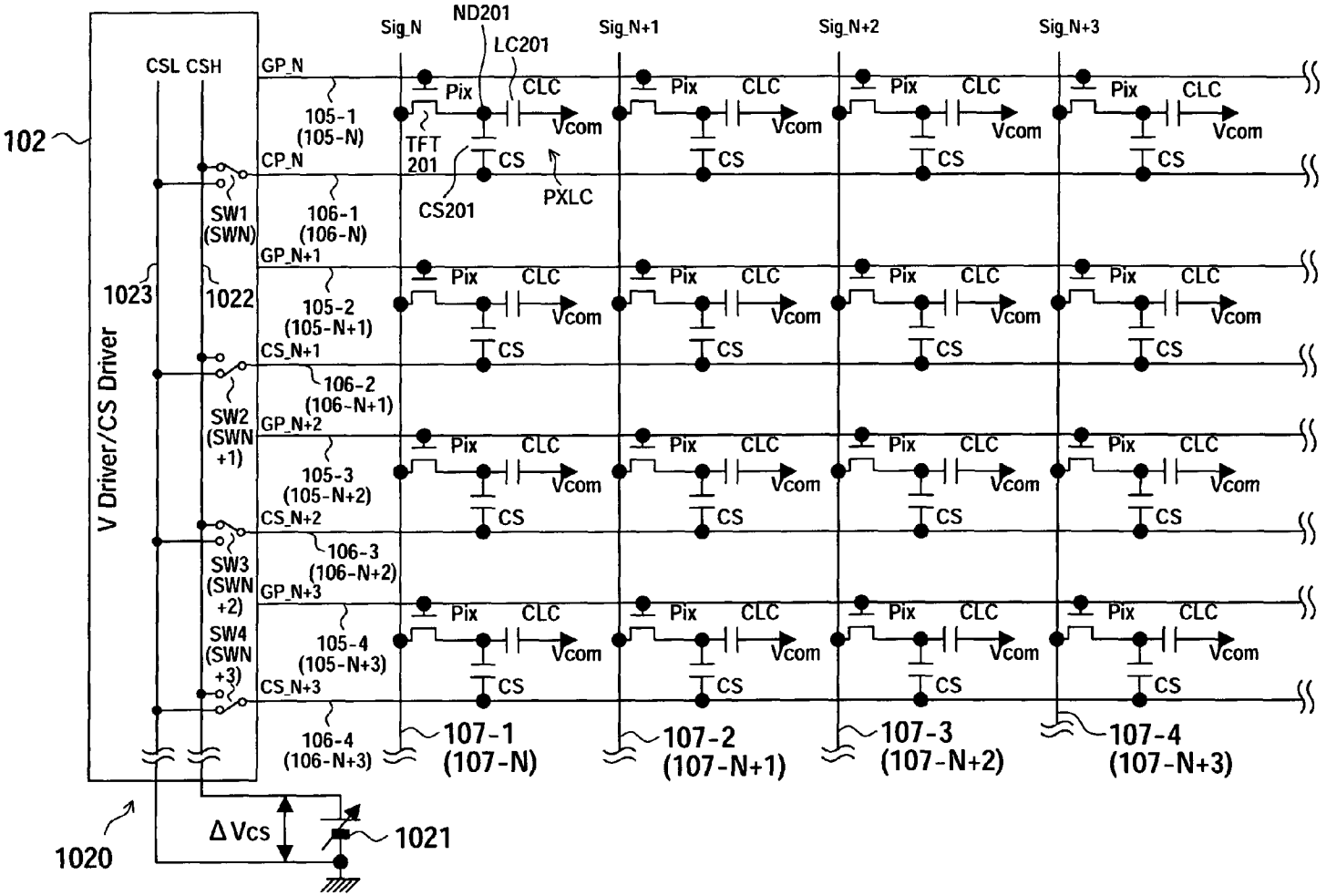
FIG. 7 is a circuit diagram showing an example of the configuration of the pixel section in a circuit inside the active matrix type display device of FIG. 6.
Figure 8:
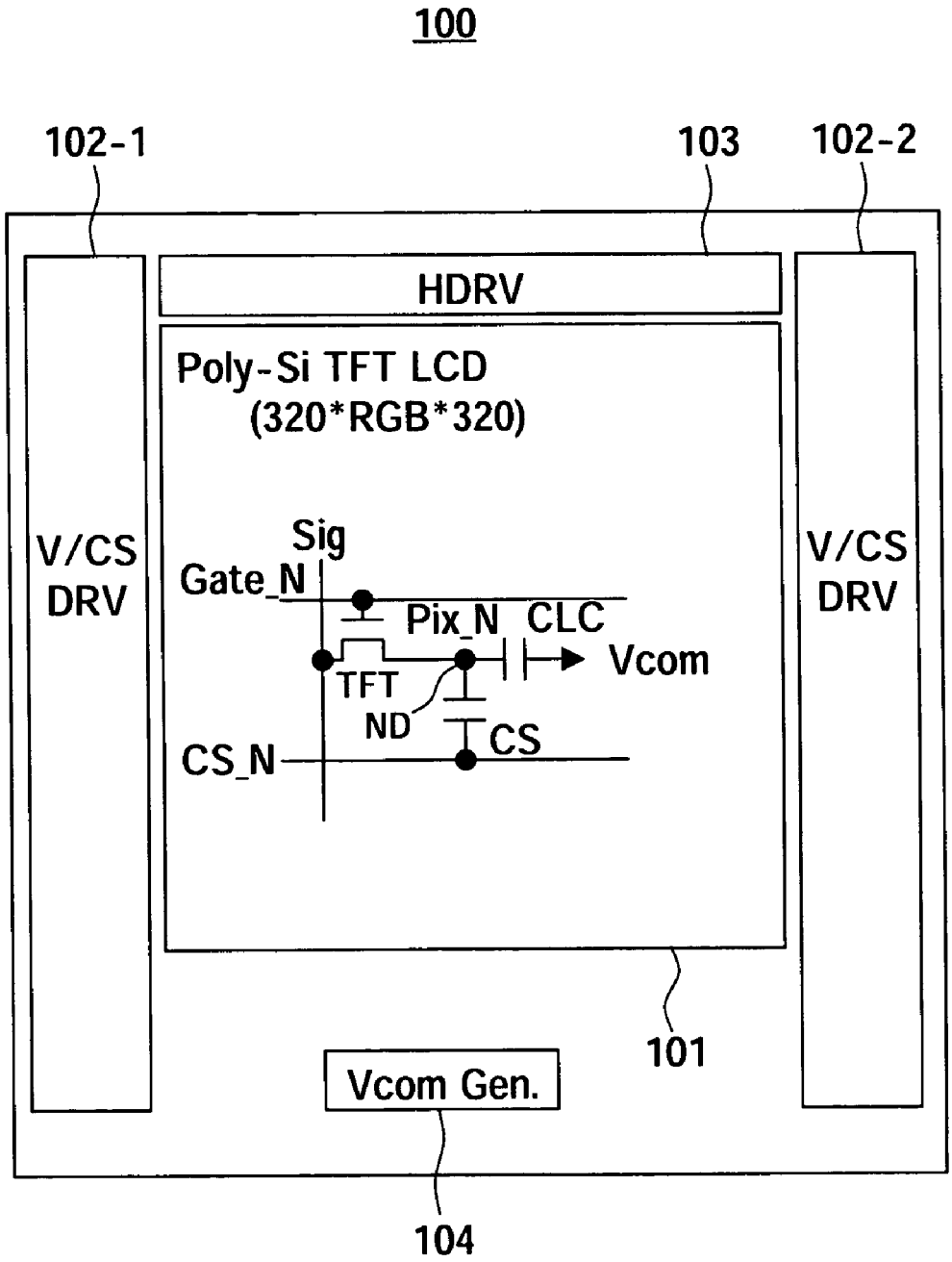
FIG. 8 is a partially enlarged view of FIG. 7.
Figure 9:
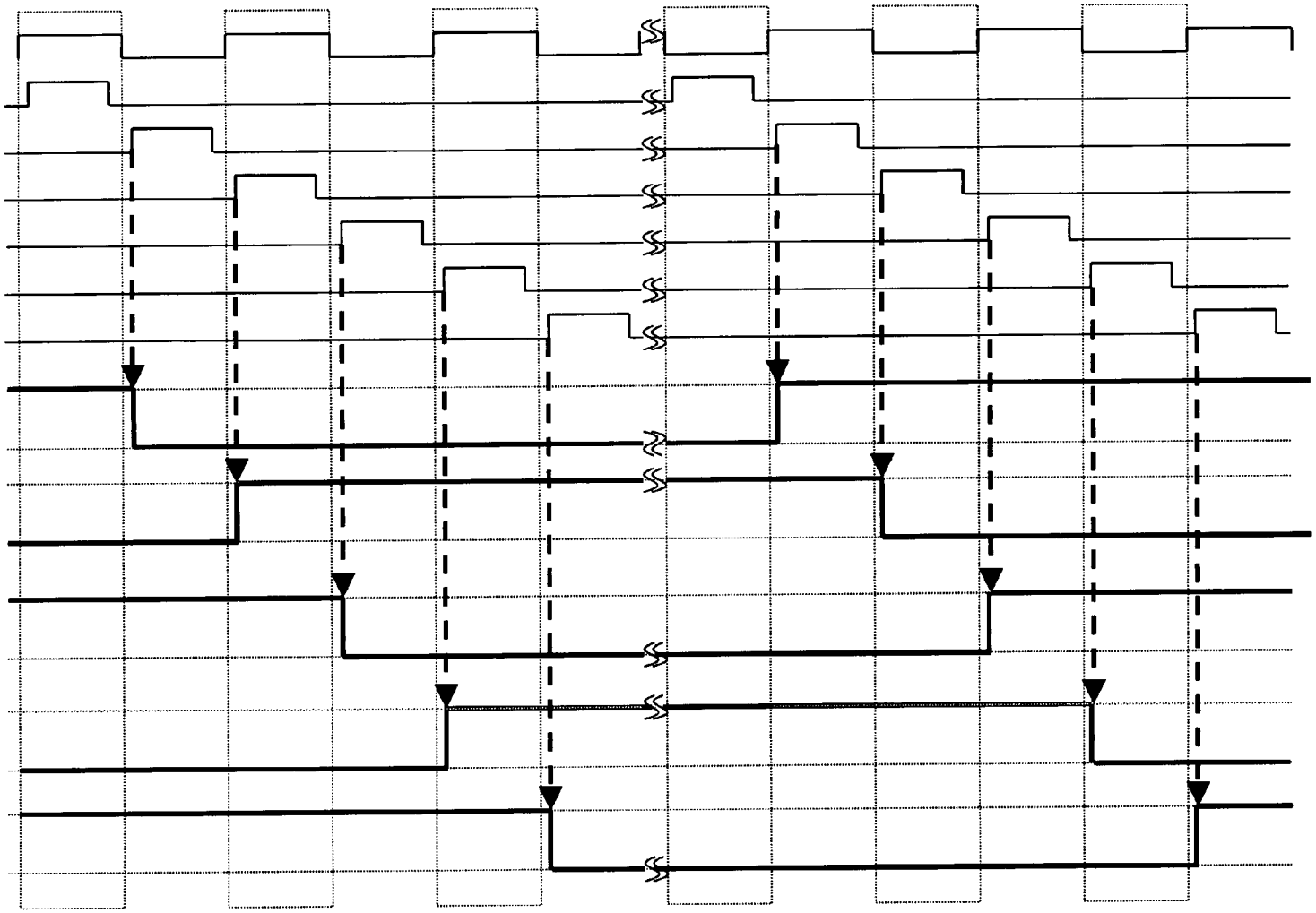
FIGS. 9A to 9L are timing charts showing an example of driving the storage line and the gate lines of the vertical drive circuit of the present embodiment.

The display device 100, as shown in FIG. 6 to FIG. 8, has as its main constituent elements an effective pixel section 101, a vertical drive circuit (VDRV) 102, a horizontal drive circuit (HDRV) 103, a common voltage generation circuit (VcomGen) 104, gate lines (scan lines) 105-1 to **105-*m*, storage capacitor lines (hereinafter referred to as the "storage lines") 106-1 to 106-*m*, signal lines 107-1 to 107-*n*, a dummy pixel section (monitor part) 108, and a detection circuit 109**.

The effective pixel section 101, as shown in FIG. 7 and FIG. 8, has a plurality of pixel circuits PXLC arrayed in an m×n matrix. Specifically, to enable normal display overall, for example, 320×RGB×320 number of pixel circuits are arrayed. Note that in FIG. 7, for simplification of the figure, this is shown as a 4×4 matrix array.

Each pixel circuit PXLC, for example, the pixel circuit 201, as shown in FIG. 7 and FIG. 8, is configured by as TFT (thin film transistor) 201 as a switching element, a liquid crystal cell LC201 with a first pixel electrode connected to a drain electrode (or source electrode) of the TFT 201, and a storage (holding) capacitor Cs201 with a first electrode connected to the drain electrode of the TFT 201. Note that connection point of the drain of the TFT 201, the first pixel electrode of the liquid crystal cell LC201, and the first electrode of the storage capacitor CS201 forms the node ND201.

Gate lines (scan lines) 105-1 to **105-*m* and storage lines 106-1 to 106-*m* are arranged along the pixel array direction for each row of these pixel circuits PXLC, and signal lines 107-1 to 107-*n*** are arranged along the pixel array direction for each column.

Further, the gate electrodes of the TFTs 201 of the pixel circuits PXLC are connected to the identical gate lines 105-1 to **105-*m* in row units. The second electrodes of the storage capacitors Cs of the pixel circuits PXLC are connected the identical storage lines 106-1 to 106-*m* in row units. Further, the source electrodes (or drain electrodes) of the pixel circuits PXLC are connected to the identical signal lines 107-1 to 107-*n* in column units. Further, the second pixel electrodes of the liquid crystal cells LC201** of the pixel circuits PXLC are connected in common to a not shown supply line of the small amplitude common voltage VCOM inverting in polarity in one horizontal scan period (1H).

The gate lines 105-1 to **105-*m* are driven by the gate driver of the vertical drive circuit 102, the storage lines 106-1 to 106-*m* are driven by the capacitor driver (CS driver) 1020 of the vertical drive circuit 102, and the signal lines 107-1 to 107-*n* are driven by the horizontal drive circuit 103**.

Further, the effective pixel section 101 is formed with a dummy pixel section 108 as a monitor circuit containing one row or one pixel. The dummy pixel section 108 has the same pixel configuration as ordinary effective pixels and can, for example, be formed by forming an extra row in the effective pixel section 101, by assigning to it the m-th row positioned at the lowest position of the effective pixel section 101, etc. This dummy pixel section 108 detects the potential of the connection node ND201 of the pixel circuit PXLC and outputs it to the detection circuit 109. The dummy pixel section 108 is provided for the following reasons. Changes in the drive temperature cause the dielectric constant and refractive index of the insulating film and liquid crystal forming a storage capacitor CS201 to fluctuate and causing the voltage applied to the liquid crystal to fluctuate, so this is provided to electrically detect the amounts of fluctuation of the liquid crystal dielectric constant and refractive index due to this temperature change and suppress the fluctuation of the voltage applied to the liquid crystal to thereby suppress changes of display due to temperature. As explained later, the storage (holding) signal CS output from the CS driver is corrected while taking into account the optical characteristics so as to enable the pixel potential detected from the dummy pixel section 108 to be any potential.

The vertical drive circuit 102 basically scans in the vertical direction (row direction) for each field period and successively selects the pixel circuits PXLC connected to the gate lines 105-1 to **105-*m* in row units. That is, the vertical drive circuit 102 gives a gate pulse GP1 to the gate line 105-1 to selects pixels of the columns of the first row and gives a gate pulse GP2 to the gate line 105-2 to selects pixels of the columns of the second row. In the same way after this, it gives the gate pulses SP3, . . . , GPm in sequence to the gate lines 105-3, . . . , 105-*m***.

Further, the vertical drive circuit 102 successively gives selected capacity signals (hereinafter referred to as "storage signals") CS1 to CSm for seleting either a first level (CSH, for example, 3V to 4V) or a second level (CSL, for example, 0V) to the storage lines 106-1 to **106-*m*** independently arranged corresponding to the gate lines.

FIGS. 9A to 9L are timing charts showing an example of driving of the storage lines and gate lines of the vertical drive circuit of the present embodiment.

The vertical drive circuit 102, for example, drives in sequence from the first row the gate lines 105-1 to **105-*m* and the storage lines 106-1 to 106-*m*, however, after driving a gate line by a gate pulse (after a signal write operation), it alternately selects and applies the first level CSH and the second level CSH as the levels of the storage signals CS1 to CSm applied to the storage lines 106-1 to 106-*m* at the timings of the rising edges of the gate pulses of the next gate lines as explained below. For example, when the vertical drive circuit 102 selects the first level CSH and applies the storage signal CS1 to the first row storage line 106-1, it selects the second level CSL and applies the storage signal CS2 to the second row storage line 106-2, selects the first level CSH and applies the storage signal CS3 to the third row storage line 106-3, and selects the second level CSL and applies the storage signal CS4 to the fourth row storage line 106-4. In the same way below, it alternately selects the first level CSH and the second level CSL and applies the storage signals CS5 to CSm to the storage lines 106-5 to 106-*m*. Further, when it selects the second level CS1 and applies the storage signal CS1 to the first row storage line 106-1, it selects the first level CSH and applies the storage signal CS2 to the second row storage line 106-2, selects the second level CSL and applies the storage signal CS3 to the third row storage line 106-3, and selects the first level CSH and applies the storage signal CS4 to the fourth row storage line 106-4. In the same way below, it alternately selects the second level CSL and the first level CSH and applies the storage signals CS5 to CSm to the storage lines 106-5 to 106*m***.

The present embodiment, after the trailing edge of the gate pulse GP (after the write operation from the signal line), drives the storage lines 106-1 to **106-*m* and couples them through the storage capacitor CS201 to cause the pixel potential (potential of the node ND201) to change and cause the voltage applied to the liquid crystal to modulate. Further, as explained later, the storage signal CS from the CS driver 1020 is corrected in a manner taking into account the optical characteristics so that the pixel potential detected by the detection circuit 109 output from the dummy pixel section 108** becomes any potential.

FIG. 7 shows an example of a level selection output unit of the CS driver 1020 of the vertical drive circuit 102. The CS driver 1020 is configured by a variable power source 1021, a first supply line 1022 connected to a positive pole side of the power source 1021, a second level supply line 1023 connected to a negative pole side of the power source 1021, and switches SW1 to SWm selectively connecting the first level supply line 1022 or the second level supply line 1023 with the storage lines 106-1 to **106-*m*** laid for each row of the pixel array.

Further, in FIG. 7, ΔVcs shows the level difference (potential difference) of the first level CSH and the second level CSL. As explained later, this ΔVcs and the amplitude ΔVcom of the alternate common voltage Vcom of the small amplitude are selected as values that can optimize both the black luminance and the white luminance. For example, as explained later, the values of ΔVcom and ΔVcs are determined so that the effective pixel potential ΔVpix_W applied to a liquid crystal at the time of the white display becomes a value of not more than 0.5V.

The vertical drive circuit 102 has a plurality of shift registers VSR containing groups of vertical shift registers and provided corresponding to gate buffers to which are connected gate lines arrayed for each row in accordance with the pixel array. Each shift register VSR is supplied with a vertical start pulse VST instructing the start of a vertical scan generated by a not shown clock generator and a vertical clock VCK serving as the reference for the vertical scan (or the vertical clocks VCK and VCKX with opposite phases). For example, each shift register performs a shift operation on the vertical start pulse VST in synchronization with the vertical clock VCK and supplies the result the corresponding gate buffer. Further, the vertical start pulse VST is propagated from the top of the effective pixel section 101 or from the bottom and is shifted in sequence into each shift register. Therefore, basically, the gate lines are driven in sequence through the gate buffers by the vertical clocks supplied from the shift registers VSR.

The horizontal drive circuit 103, based on the horizontal start pulse HST instructing the start of the horizontal scan and the horizontal clock HCK (or the horizontal clocks HCK and HCKX with opposite phases) serving as the reference of the horizontal scan, successively samples the input video signal Vsig at each 1H (H is the horizontal scan period) and performs a write operation on the pixel circuits PXLC selected in row units through the signal lines 107-1 to **107-*n* by the vertical drive circuit 102**.

Figure 10:
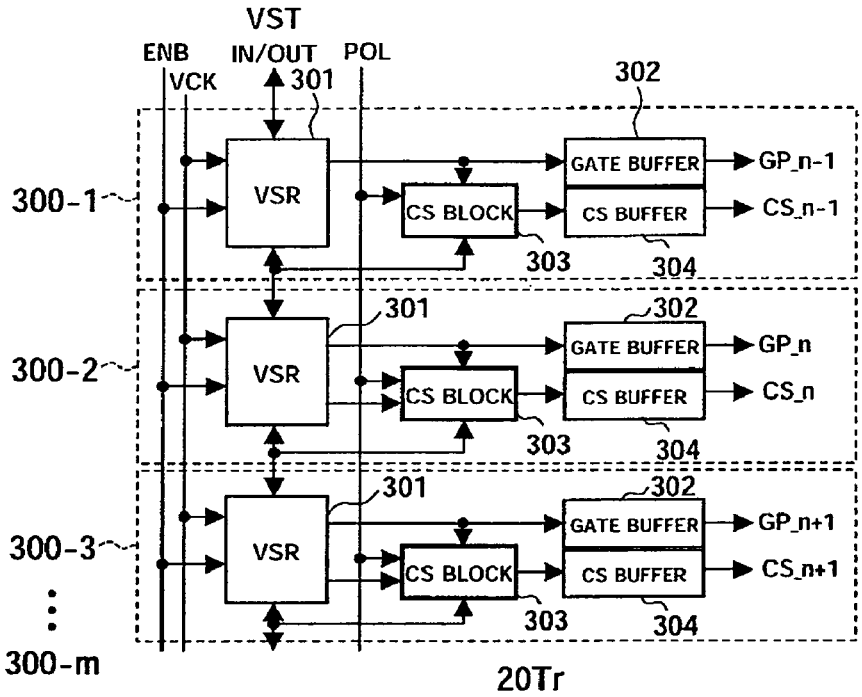
FIG. 10 is a block diagram showing an example of the configuration of a CS driver and gate driver of a vertical drive circuit of the present embodiment.

FIG. 10 is a block diagram showing an example of the configuration of a CS driver and a gate driver of the vertical drive circuit of the present embodiment.

The vertical drive circuit 102 of the present embodiment is provided with driver stages 300-1, 300-2, 300-3, . . . **300-*m*** driving independently at each row of the pixel array.

Each driver stage 300(-1 to **-*m*) has a shift register (VSR) 301, a gate buffer 302, a CS block 303, and a CS buffer 304. For example, the CS buffer 304** has the combined functions of the level selection output unit of the above-explained CS driver.

The shift register 301 performs a shift operation on the vertical start pulse VST synchronized with the enable signal ENB and vertical clock VCK and supplies the result to the corresponding gate buffer 302. Further, the vertical start pulse VST is propagated from the top side of the effective pixel section 101 or from the bottom side and is shifted in sequence into each shift register. Therefore, basically, the gate lines 105-1 to **105-*m* are driven in sequence through the gate buffer by the vertical clock supplied by the shift register 301**.

The CS block performs independent operations at each driver stage. Based on the gate signal Gate output from the shift register 301 to the gate buffer 302 and the signal VSRout output from the shift register 301 to the next stage shift register, it latches the polarity signal POL in two stages, then outputs it to the CS buffer 304.

Figure 11:
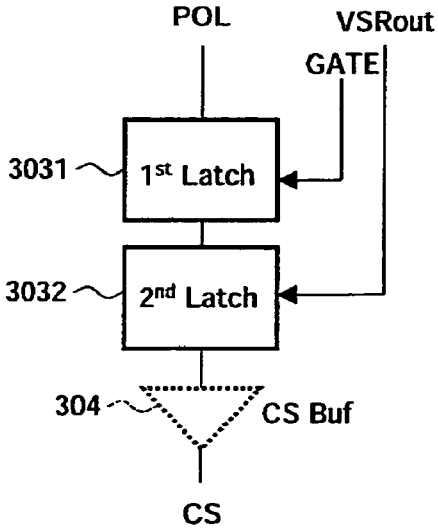
FIG. 11 is a diagram showing the basic configuration of the CS block of FIG. 10.

FIG. 11 is a diagram showing the basic configuration of a CS block of FIG. 10. The CS block 303 basically has a first latch 3031 latching the polarity signal POL based on the gate signal Gate and a second latch 3032 which latches the latch signal POL of the first latch 3031 based on the signal VSRout and output it to the CS buffer 304 at a predetermined timing.

Figure 12:
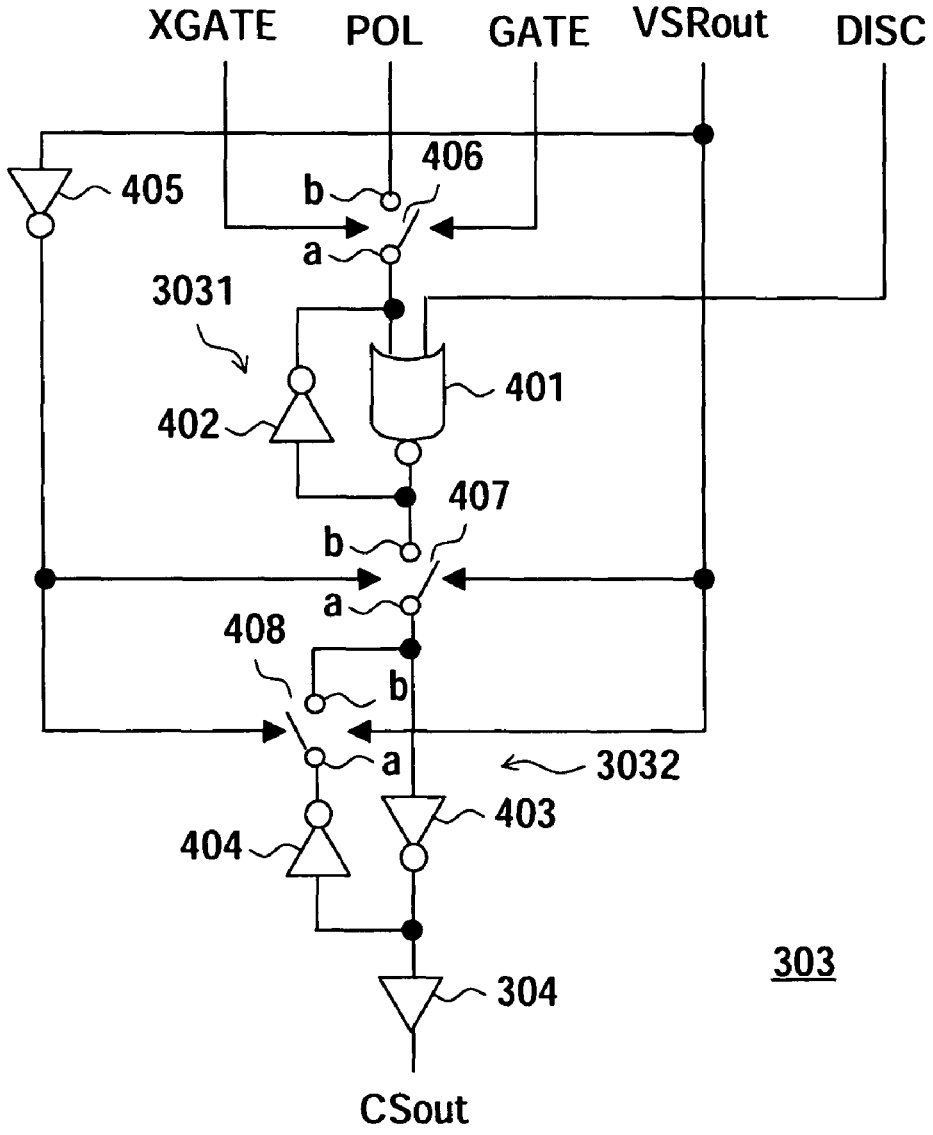
FIG. 12 is a circuit diagram showing a specific example of the configuration of the CS block.

FIG. 12 is a circuit diagram showing a specific example of the configuration of a CS block.

This CS block 303 has a two-input NAND 401, inverters 402 to 405, and switch circuits 406 to 408. Further, the NAND401 and the inverter 402 configure the first latch 3031, while the inverters 403 and 404 configure the second latch 3032.

The first input of the NAND 401 is connected to the fixed contact a of the switch 406 and the output terminal of the inverter 402, the second input is connected to the input line of the signal DISC, and the output is connected to the working contact b of the switch 407 and the input terminal of the inverter 402. The input terminal of the inverter 403 is connected to the fixed contact a of the switch 407 and the working contact b of the switch 408, while the output terminal is connected to the input terminal of the inverter 404 and the input of the CS buffer 304. Further, the output terminal of the inverter 404 is connected to the fixed contact a of the switch 408. The switch 406 is turned on and off by the gate signal Gate and the inverted signal XGate. The switches 407 and 408 are turned on and off by the signal VSRout and the signal VSRout inverted by the inverter 405.

Figure 13:
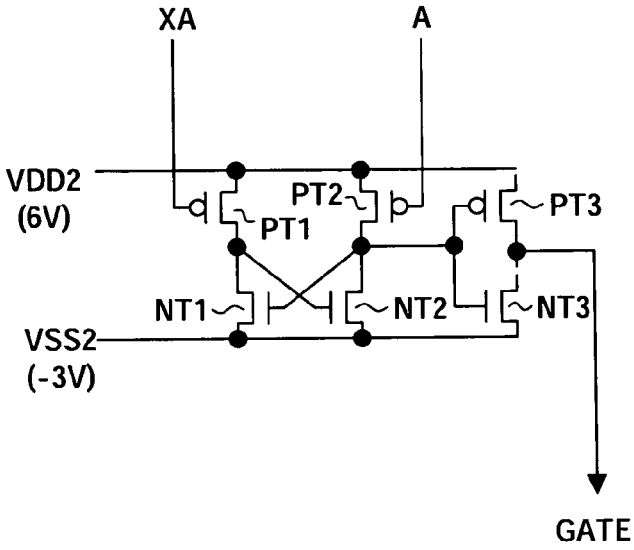
FIG. 13 is a circuit diagram showing an example of the configuration of a gate buffer.

FIG. 13 is a circuit diagram showing an example of the configuration of a gate buffer. The gate buffer 302, as shown in FIG. 13, is configured by the p-channel MOS (PMOS) transistors PT1 to PT3 and the n-channel MOS (NMOS) transistors NT1 to NT3. The sources of the PMOS transistors PT1 to PT3 are connected to a supply line of a high voltage (for example, 6V) power voltage VDD2, while the sources of the NMOS transistors NT1 to NT3 are connected to a supply line of a low voltage (for example, −3V) power voltage VSS2. The drain of the PMOS transistor PT1 and the drain of the NMOS transistor NT1 are connected to each other, and the connection point is connected to the gate of the NMOS transistor NT2. The drain of the PMOS transistor PT2 and the drain of the NMOS transistor NT2 are connected to each other, and the connection point is connected to the gate of the NMOS transistor NT1 and the gate of the PMOS transistor PT3 and the gate of the NMOS transistor NT3 forming the output buffer stage. Further, the drain of the PMOS transistor PT3 and the drain of the NMOS transistor NT3 are connected, and the connection point is connected to the gate line. Further, the gate of the PMOS transistor PT2 is connected to the supply line of signal A, and the gate of the PMOS transistor PT1 is connected to the supply line of the inverted signal XA of the signal A. In this way, the gate buffer is configured by a level shifter and output buffer stage.

Figure 14:
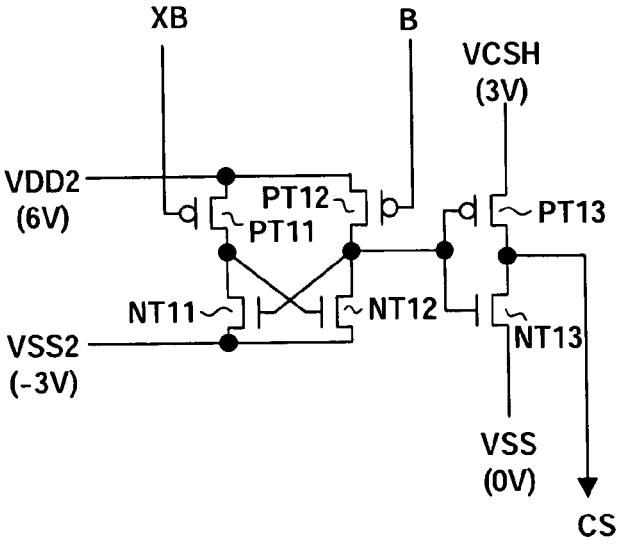
FIG. 14 is a circuit diagram showing an example of the configuration of a CS buffer.
Figure 15:
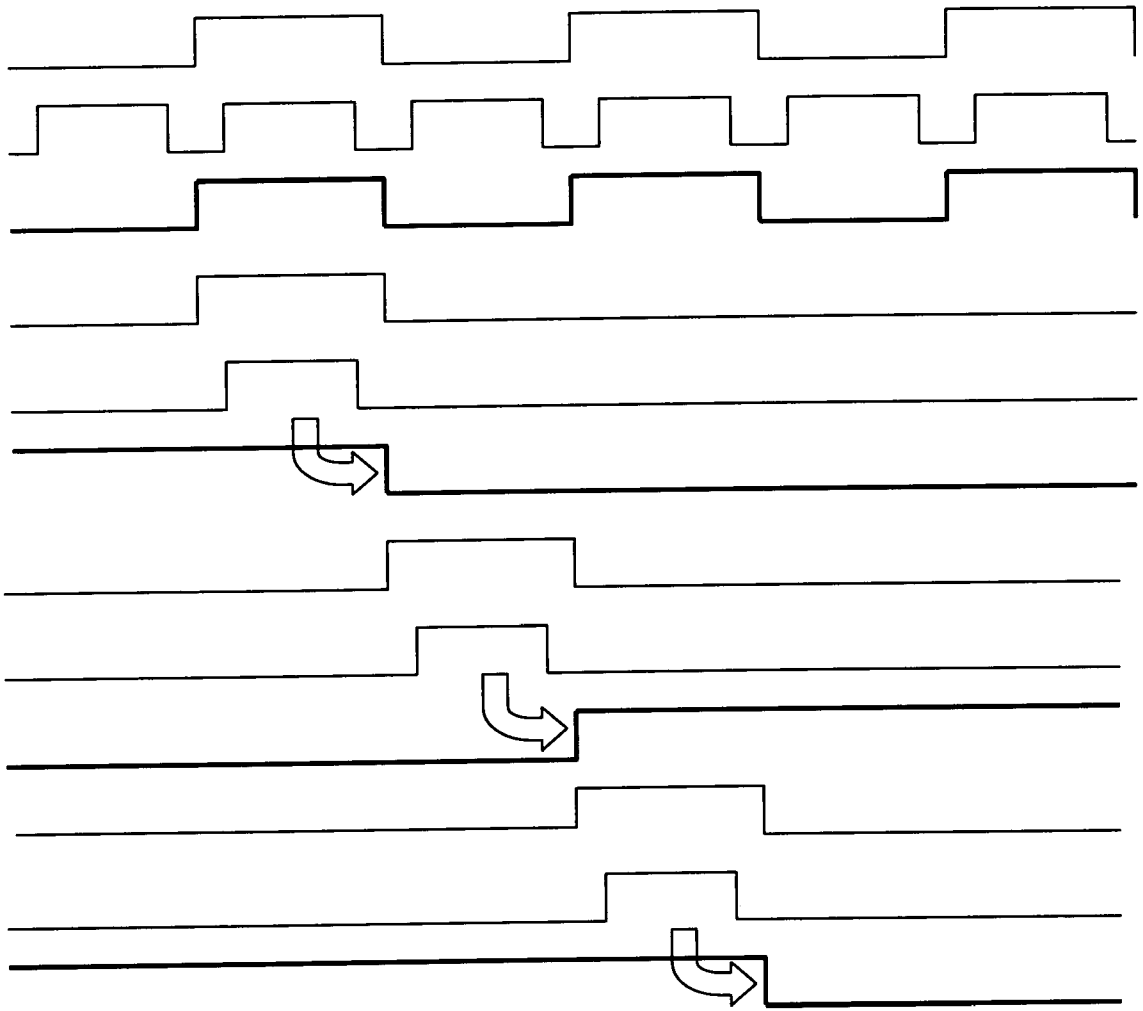
FIGS. 15A to 15L are timing charts showing an example of the operation of the vertical drive circuit of FIG. 10.

FIG. 14 is a circuit diagram showing an example of the configuration of a CS buffer. The CS buffer 304, as shown in FIG. 14, is configured by the PMOS transistors PT11 to PT13 and the NMOS transistors NT11 to NT13. The sources of the PMOS transistors PT11 and PT12 are connected to a supply line of a high voltage (for example, 6V) power voltage VDD2, while the sources of the NMOS transistors NT11 and NT12 are connected to a supply line of a low voltage (for example, −3V) power voltage VSS2. The source of the PMOS transistor PT13 is connected to a supply line of a first level voltage (for example, 3V) power voltage VCSH, while the source of the NMOS transistor NT13 is connected to a supply line of a second level voltage (for example, 0V) power voltage VSS. The drain of the PMOS transistor PT11 and the drain of the NMOS transistor NT11 are connected to each other, and the connection point is connected to the gate of the NMOS transistor NT12. The drain of the PMOS transistor PT12 and the drain of the NMOS transistor NT12 are connected to each other, and the connection point is connected to the gate of the NMOS transistor NT13 and the gate of the PMOS transistor PT13 and the gate of the NMOS transistor NT11 comprising the output buffer stage. Further, the drain of the PMOS transistor PT13 and the drain of the NMOS transistor NT13 are connected to each other, and the connection point is connected to the gate line. Further, the gate of the PMOS transistor PT12 is connected to a supply line of the signal B, and the gate of the PMOS transistor PT11 is connected to a supply line of an inverted signal XB of the signal B. In this way, the gate buffer is configured by a level shifter and output buffer stage. Further, signals B, XB are switching signals.

FIGS. 15A to 15L are timing charts showing an example of operation of the vertical drive circuit of FIG. 10. The CS driver in the vertical drive circuit 102 of the present embodiment is not dependent on the surrounding drive stages or the polarity of the previous frame and determines the polarity of the CS signal only by the polarity (shown by POL) of the time of a pixel write operation. That is, it does not depend on the signal of the surrounding stages in the present embodiment and is controllable by only a signal of its own stage. Further, the CS blocks etc. of the vertical drive circuit of the present embodiment can be formed by small numbers of elements and therefore contribute to the reduction of circuit size. For example, they may be configured by 20 or less transistors.

Note also that one vertical drive circuit having the above configuration and functions can be positioned at first ends of the gate lines and storage lines of one side of the effective pixel section 101, however, in the configuration of FIG. 8, vertical drive circuits 102 containing gate drivers and CS drivers are positioned at the two ends of the gate lines and storage lines of the effective pixel section 101. This is due to the following reasons.

In a pixel where the gate signal has become the high level and a write operation is permitted, a positive polarity (or negative polarity) display signal voltage of with respect to the Vcom potential is written in the pixel electrode. At this time, the storage line (CS line) connected to the pixel electrode on which the write operation is performed through the storage capacitor is shaken by the coupling received from the pixel electrode. Therefore, in the present embodiment, vertical drive circuits containing CS drivers are positioned at the two sides to shorten the convergence time of this shaking and thereby improve the shading etc. in the horizontal direction.

Further, after the pixel write operation concludes and the gate signal becomes a low level, the potential of the storage line forming the pixel and the storage capacitor has a parasitic cross capacity with the signal line. The potential of this storage line is therefore shaken by the coupling of this capacity. Further, in the present embodiment, the vertical drive circuits containing the CS driver are placed on both sides, and the shading, etc. of the horizontal direction is improved by shortening the convergence time of this shaking.

That is, when the drive ability for maintaining a constant voltage against noise received by the resistance and capacity load of the storage line from the signal line or pixel electrode etc. is not sufficient with just the drive by the CS driver of one side, vertical drive circuits 102 containing gate drivers and CS drivers are placed at the two ends of the gate lines and storage lines of the effective pixel section 101 to raise the driving ability of the storage lines.

Figure 16:
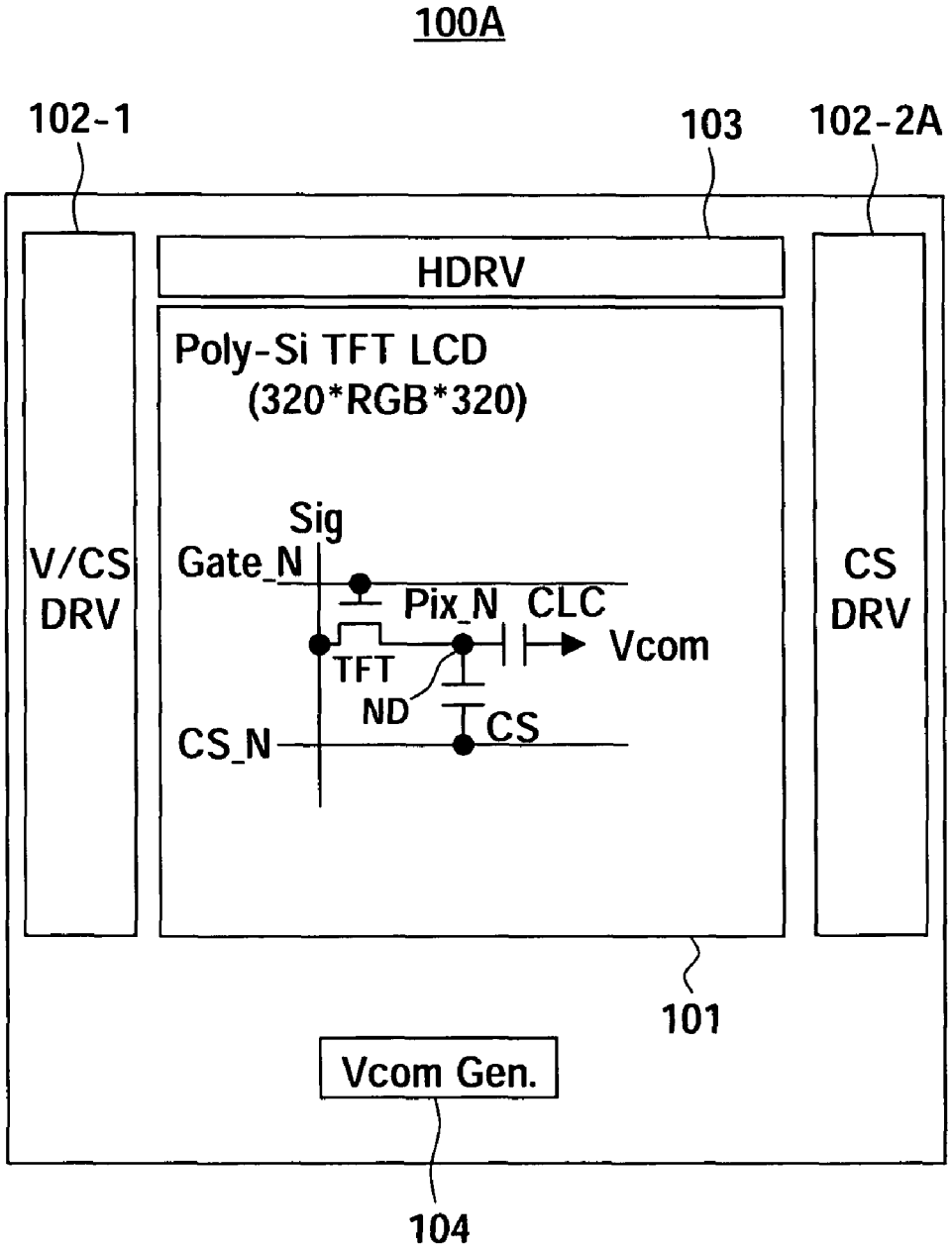
FIG. 16 is a diagram showing a configuration wherein a vertical drive circuit containing a gate driver and CS driver is positioned on one side of the effective pixel section and a vertical drive circuit containing only a CS driver is positioned on the other side.

Note that if placing vertical drive circuits containing gate drivers and CS drivers at both sides (the left and right sides in the figure) of the effective pixel section 101 as explained above, the scan timing at the two sides may deviate, so, for example, as shown in FIG. 16, it is possible to place a first vertical drive circuit 102-1 containing a gate driver and CS driver at only one side (the left side in the figure) of the effective pixel section 101 and place a second vertical drive circuit 102-2*a* containing only a CS driver at the other side. By employing this configuration, it is possible to suppress the deviation in scan timing, reduce the circuit size, and realize edge narrowing.

Figure 17:
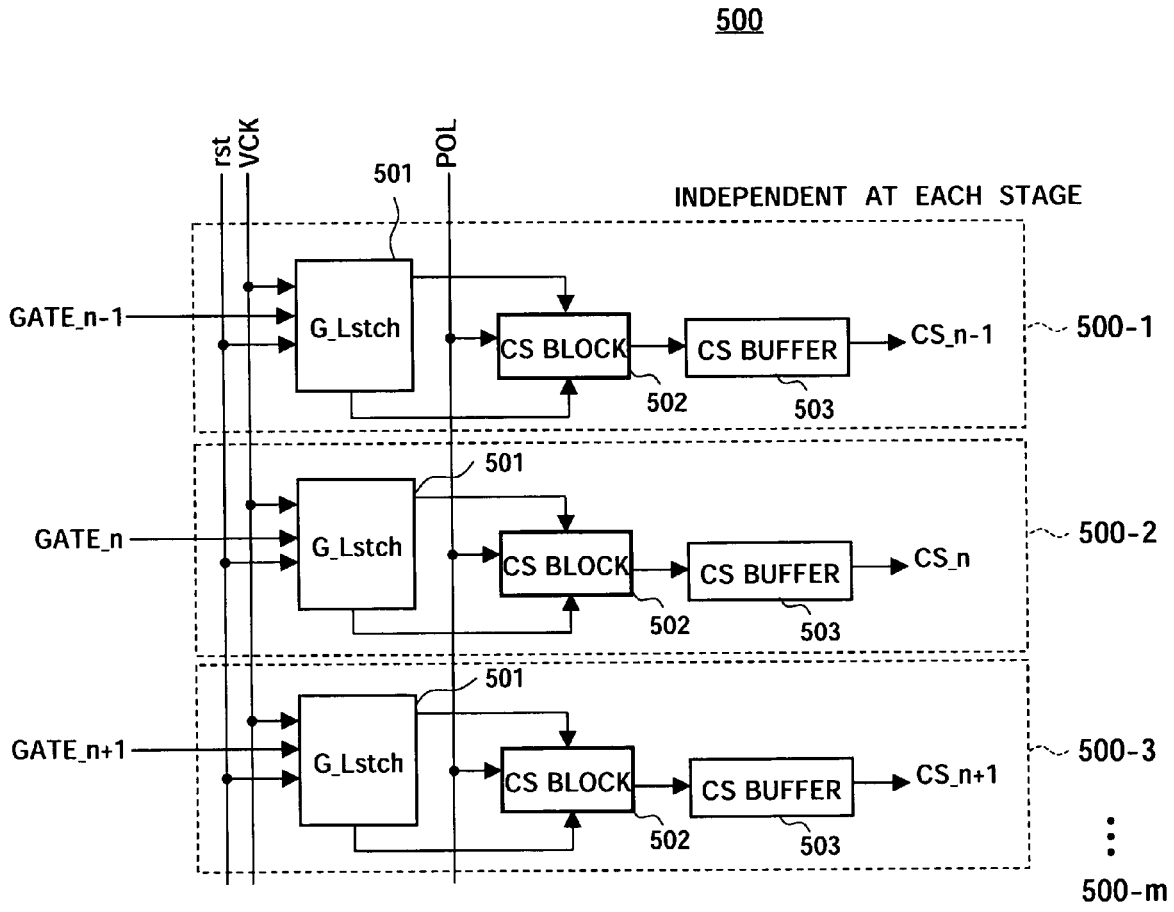
FIG. 17 is a block diagram showing an example of the configuration of a vertical drive circuit containing only a CS driver.

FIG. 17 is a block diagram showing an example of the configuration of a vertical drive circuit containing only a CS driver.

The CS driver 500 of the vertical drive circuit 102-2A of FIG. 17 is provided with driver stages 500-1, 500-2, 500-3, . . . , 500-*m* independently driving rows of the pixel array.

Each driver stage 500(-1 to -*m*) has a gate latch (G-Latch) 501, a CS block 502, and a CS buffer 503. For example, the CS buffer 503 also has the function of the level selection output unit of the above-explained CS driver.

The gate latch 501 latches the gate signal Gate propagated over the gate lines 105-1 to 105-*m* positioned on the corresponding row of the pixel array, outputs the gate signal Gate to the CS block 502 as a signal OUTA only in the period when it is active, latches the vertical clock VCK at a predetermined timing in synchronization with the gate signal Gate, and resets the gate signal Gate latched and ceases the output of the signal OUTA at a timing when the level of the latched vertical clock VCK switches.

Figure 18:
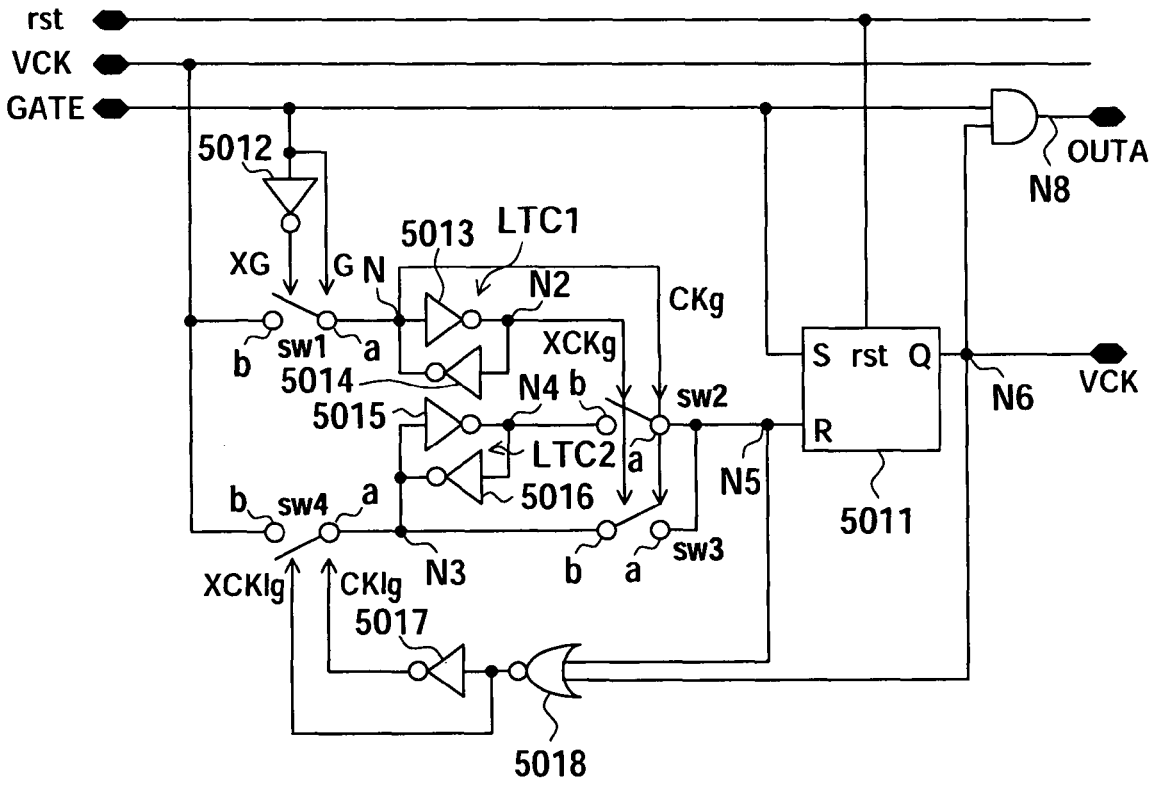
FIG. 18 is a circuit diagram showing an example of the configuration of the gate latch of FIG. 17.
Figure 19:
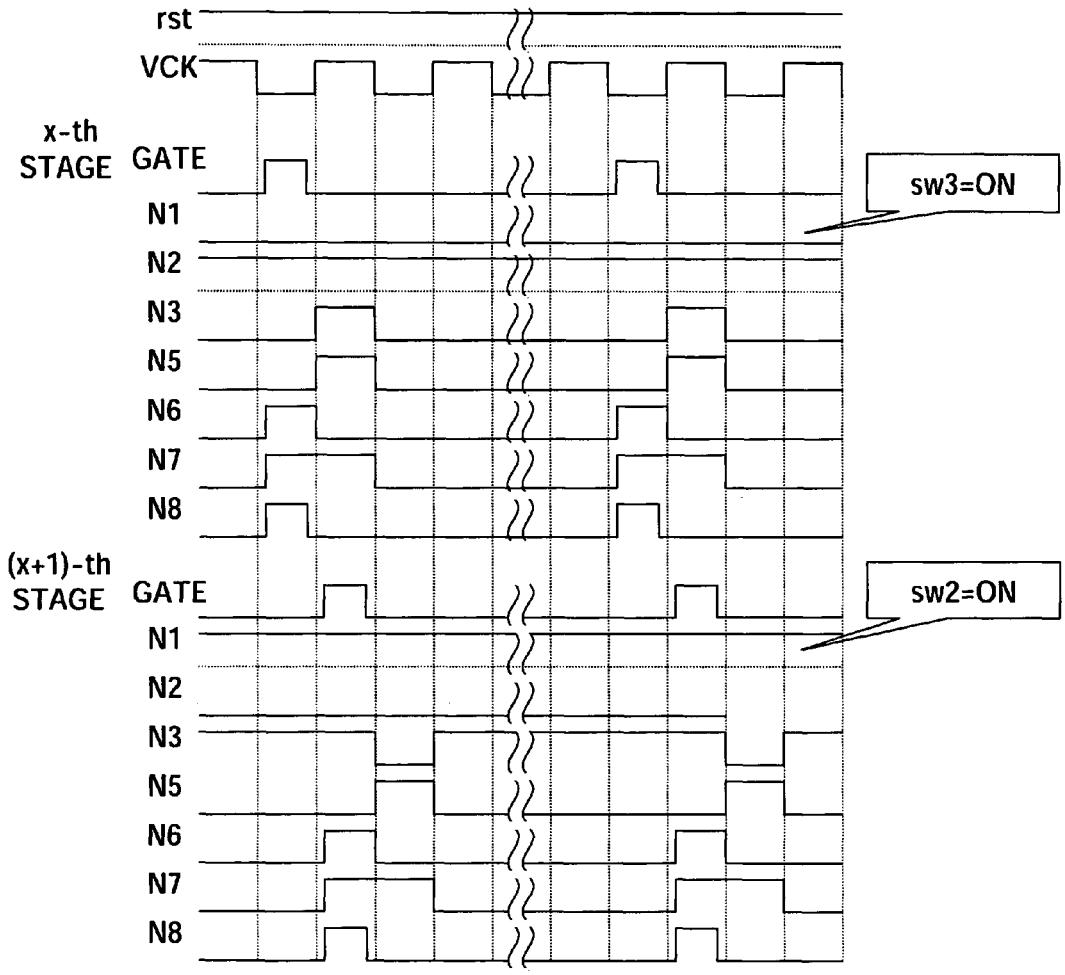
FIG. 19 is a timing chart showing principal nodes of the circuit of FIG. 18.

FIG. 18 is a circuit diagram showing an example of the configuration of the gate latch of FIG. 17. Further, FIG. 19 is a timing chart of the principal nodes of the circuit of FIG. 18.

The gate latch 501, as shown in FIG. 18, has a flipflop 5011, inverters 5012 to 5017, a two-input NOR 5018, a two-input NAND 5019, and switches SW1 to SW4.

A terminal S of the flipflop 5011 is connected to the input line of the gate signal Gate, a reset terminal R is connected to a node N5, a terminal Q is connected to one input of the NOR 5018 and one input of the NAND 5019, and a reset terminal rst is connected to an input line of the reset signal rst. The other input of the NOR 5018 is connected to the node N5, and the other input of the NAND 5019 is connected to the input line of the gate signal Gate.

The inverters 5013 and 5014 couple the appropriate inputs and outputs to configure the latch LTC1, while the inverters 5015 and 5016 couple the appropriate inputs and outputs to configure the latch LTC2. The node N1 of the latch LTC1 is connected to a fixed contact a of the switch SW1, while a working contact b of the switch SW1 is connected to an input line of the vertical clock CVK. The switch SW1 is turned on and off by the gate signal Gate(G) and the signal XG inverted by the inverter 5011. In this example, the switch is turned on when the gate signal G is a high level and turned off when it becomes a low level. The node N3 of the latch LTC2 is connected to a fixed contact a of the switch SW4, and a working contact b of the switch SW4 is connected to an input line of the vertical clock CVK. The switch SW4 is turned on when the output signal CKLg of the inverter 5017 is at a high level and the output signal of the NOR 5018 that becomes the input signal of the inverter 5017 is at a low level and is turned off when the output signal CKLg of the inverter 5017 is at a low level and the output signal XCLKg of the NOR 5018 that becomes the input signal of the inverter 5017 is at a high level.

A fixed contact a of the switch SW2 is connected to the node N5, while a working contact b is connected to the node N4 of the latch LTC2. A fixed contact a of the switch SW3 is connected to the node N5, while a working contact b is connected to the node N3 of the latch LTC2. The switch SW2 is turned on when the node ND1 of the latch LTC1 is at a high level and the signal XCKg of the node N2 is at a low level and is turned off when the signal CKg of the node N1 is at a low level and the signal XCKg of the node N2 is at a high level. The switch SW3 is turned on when the signal CKg of the node N1 of the latch LTC1 is at a low level and the signal XCKg of the node N2 is at a high level and is turned off when the signal CKg of the node N1 is at a high level and the signal XCKg of the node N2 is at a low level.

For example, in the example of FIG. 19, in the (x)-th row (stage), the gate signal Gate is input to the gate latch 501-*x* as a high level pulse signal in the period when the vertical clock VCK is at a low level. Further, the gate signal Gate is set in the flipflop 5011. As a result, the node N6 becomes a high level.

At this time, the switch SW1 is turned on, and a low level vertical clock is input to the latch LTC1. As a result, the node N1 and the node N2 of the latch LTC1 are maintained at the low level and the high level respectively. Therefore, the switch SW2 is turned off, and SW3 is turned on. Further, because the node N6 is at a high level, the output of the NOR 5018 become a low level and, as a result, the output of the inverter 5017 becomes a high level, and the switch SW4 is turned on. Because the switch SW4 is turned on, a low level vertical clock VCK is input in the latch LTC2. As a result, the node N3 and the node N4 of the latch LTC1 are maintained at the low level and the high level respectively. Therefore, at this timing, through the switch SW3, the node N5 SW3 is at the low level, and the flipflop 5011 is not reset. Further, the AND 5019 outputs the high level signal OUTA to the CS block 502 in the period when the gate signal Gate is at a high level. Next, the vertical clock VCK switches from the low level to the high level, whereby the gate signal Gate also switches to the low level. As a result, the output signal OUTA becomes the low level, and further, a high level vertical clock VCK is input to the latch LTC2. As a result, the node N3 and the node N4 of the latch LTC2 are maintained at the high level and the low level respectively. Therefore, at this timing, the node N5 is held at the high level through the switch SW3, the flipflop 5011 is reset, and further, the switch SW4 is maintained in the on state until the vertical clock VCK becomes the low level.

Further, in the example of FIG. 19, in the (x+1)-th row (stage), the gate signal Gate is input to the gate latch 501-*x*+1 as a high level pulse signal in the period when the vertical clock VCK is at a high level. Further, the gate signal Gate is set in the flipflop 5011. As a result, the node N6 becomes a high level. At this time, the switch SW1 is turned on, and a high level vertical clock VCK is input to the latch LTC1. As a result, the node N1 and the node N2 of the latch LTC1 are maintained at the high level and the low level respectively. Therefore, the switch SW2 is turned on, and the SW3 is turned off. Further, because the node N6 is at a high level, the output of the NOR 5018 becomes a low level, and as a result, the output of the inverter 5017 becomes a high level, and the switch SW4 is turned on. Because the switch SW4 is turned on, the high level vertical clock VCK is input in the latch LTC2. As a result, the node N3 and the node N4 of the latch LTC1 are maintained at the high level and the low level respectively. Therefore, at this timing, through the switch SW2, the node N5 is at the low level, and the flipflop 5011 is not reset. Further, the AND 5019 outputs a high level signal OUTA to the CS block 502 in the period when the gate signal Gate is at a high level. Next, the vertical clock VCK switches from the high level to the low level, whereby the gate signal Gate also switches to the low level. As a result, the output signal OUTA becomes the low level, and further, a low level vertical clock VCK is input in the latch LTC2. As a result, the node N3 and the node N4 of the latch LTC2 are maintained at the low level and the high level respectively. Therefore, at this timing, the node N5 is held at the high level through the switch SW3, the flipflop 5011 is reset, and further the switch SW4 is maintained in the on state until the vertical clock VCK becomes the high level.

The CS block 502 performs independent operations at the different driver stages. Based on the gate signal Gate (OUTA) outputting from the gate latch 501, for example, it latches the polarity signal POL at two stages, then outputs it to the CS buffer 503.

Note that the CS block 502 and CS buffer 503 can employ the same configuration as the configuration explained according to FIG. 11 and FIG. 14.

The common voltage generation circuit 104 generates the small amplitude common voltage VCOM inverting in polarity at each horizontal scan period (1H) and passes it through not shown supply lines to supply it in common to the second pixel electrodes of the liquid crystal cells LC201 of all pixel circuits PXLC of the effective pixel section 100. The value of the amplitude ΔVcom of the amplitude of the common voltage Vcom is selected as a value that can optimize the difference ΔVcs between the first level CSH and second level CSL of the storage signal CS and the black luminance and the white luminance. For example, as explained later, the values of ΔVcs and ΔVcom are determined so that the value of the effective pixel potential ΔVpix_W applied to the liquid crystal at the time of white display becomes no more than 0.5V.

In FIG. 6, a configuration in which the common voltage generation circuit 104 is provided inside the liquid crystal panel is shown as an example, however, it is also possible to provide it outside the panel and supply the common voltage Vcom from outside the panel.

FIG. 20 is a circuit diagram showing an example of the configuration of a common voltage generation circuit according to the present embodiment. In the example of FIG. 20, a case where a small amplitude common voltage Vcom is generated outside of the panel is shown.

The common voltage generation circuit of FIG. 20 is configured by flicker adjustment resistance elements R1 and R2, a smoothening capacitor C1, a capacitor C2 for applying only a small amplitude ΔVcom, a line resistance Rcom of the Vcom supply line 108, and a parasitic capacity Ccom of the Vcom supply line 108.

The resistance elements R1 and R2 are serially connected between the power voltage VCC supply line and the ground line GND. A voltage divided by the two resistance elements R1 and R2 is generated at the connection node ND1 of the resistance elements. The resistance element R2 is a variable resistance and enable the generated voltage to be adjusted. The connection node ND1 is connected to a panel terminal T. A first electrode of the capacitor C1 is connected to a connection line of the connection node ND1 and the terminal T, while a second electrode of the capacitor C1 is grounded. A first electrode of the capacitor C2 is connected to a connection line of the connection node ND1 and the terminal T, while a second electrode is connected to a supply line of the signal FRP.

In the common voltage generation circuit of FIG. 20, the small amplitude ΔVcom is determined according to the following equation:

$$\Delta Vcom=\{C2/(C1+C2+Ccom)\}\times FRP \quad (2)$$

For the small amplitude, it is possible to use capacity coupling or to digitally generate and use it. The value of the small amplitude ΔVcom is an extremely small amplitude, for example, should be an amplitude of 10 mV to 1.0V or so. The reasons are that otherwise, the improvement of the response speed by overdrive, the reduction of audio noise, and other effects weaken.

As explained above, in the present embodiment, when the liquid crystal display device 100 is driven utilizing capacity coupling, the value of the amplitude ΔVcom of the amplitude of the common voltage Vcom and the value of the difference ΔVcs between the first level CSH and second level CSL of the storage signal CS are selected as values that can optimize the black luminance and white luminance. For example, the values of ΔVcs and Δvcom are selected so that effective pixel potential ΔVpix_W applied to the liquid crystal at the time of white display becomes a value less than 0.5V. Below, the capacity coupling drive operation of the present embodiment will be explained in further detail.

FIGS. 21A to 21E are timing charts showing the drive waveforms of the main liquid crystal cells of the present embodiment. FIG. 21A shows the gate pulse GP_N, FIG. 21B shows the common voltage Vcom, FIG. 21C shows the storage signal CS_N, FIG. 21D shows the video signal Vsig, and FIG. 21E shows the signal Pix_N applied to the liquid crystal cells.

Figure 22:
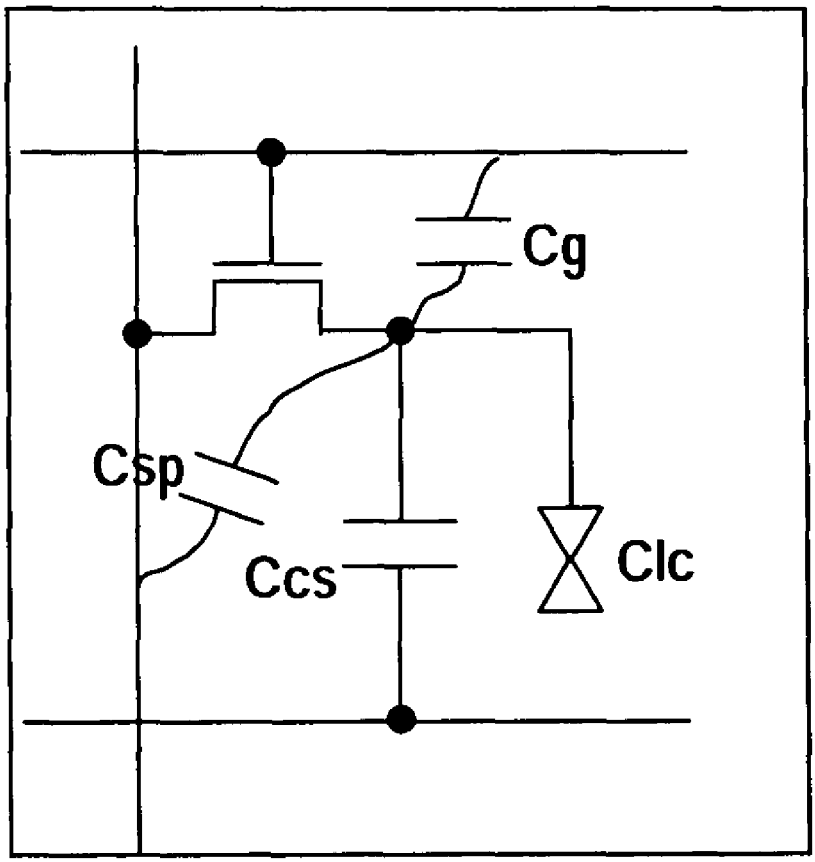
FIG. 22 is a diagram showing capacitors in the liquid crystal cells in equation 3.

In the capacity coupling drive operation of the present embodiment, the common voltage Vcom is generated not as a constant direct current voltage, but as a small amplitude, alternating signal inverting in polarity at each horizontal scan period (1H) and is applied in the second pixel electrode of the liquid crystal cell LC201 of each pixel circuit PXLC. Further, the storage signal CS_N is given selected as either a first level (CSH, for example, 3V to 4V) or a second level (CSL, for example, 0V) at each of the storage lines 106-1 to **106-*m* arranged independently in accordance with each gate line. When driven in this way, with reference to FIG. 22**, the effective pixel potential ΔVpix applied to the liquid crystals is given by the following equation.

$$\Delta Vpix3 = Vsig + \frac{Ccs}{Ccs + Clc + Cg + Csp} * \Delta Vcs + \frac{Clc}{Ccs + Clc + Cg + Csp} * \frac{\Delta Vcom}{2} - Vcom \approx Vsig + \left(\frac{Ccs}{Ccs + Clc} * \Delta Vcs\right) + \left(\frac{Clc}{Ccs + Clc} * \frac{\Delta Vcom}{2}\right) - Vcom \quad (3)$$

In equation (3), the second term {(Ccs/Ccs+Clc)* ΔVcs} of the approximation equation is a term wherein the low shade (the white luminance side) becomes black (drops) due to the nonlinearity of the liquid crystal dielectric constant, while the third term {(Ccl/Ccs+Clc)*ΔVcom/2} of the approximation equation is a term where the low shade side becomes whiter due to the nonlinearity of the liquid crystal dielectric constant. That is, the inclined part where the low shade (white luminance side) of the second term of the approximation equation becomes blacker (drops) is compensated for by the function of whitening the low shade side by the third term. Further, the optimum contrast can be obtained by selecting values that can optimize both the black luminance and the white luminance.

Figure 23A:
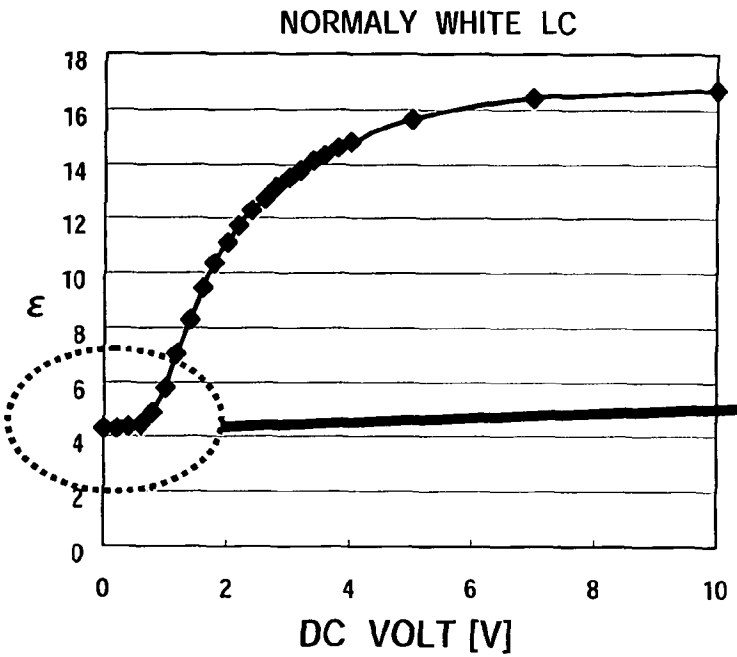
FIGS. 23A and 23B are graphs explaining the selection criteria of the effective pixel potential ΔVpix_W applied to the liquid crystal at the time of the white display in a case of using a liquid crystal material used in a liquid crystal display device (normally white)
Figure 23B:
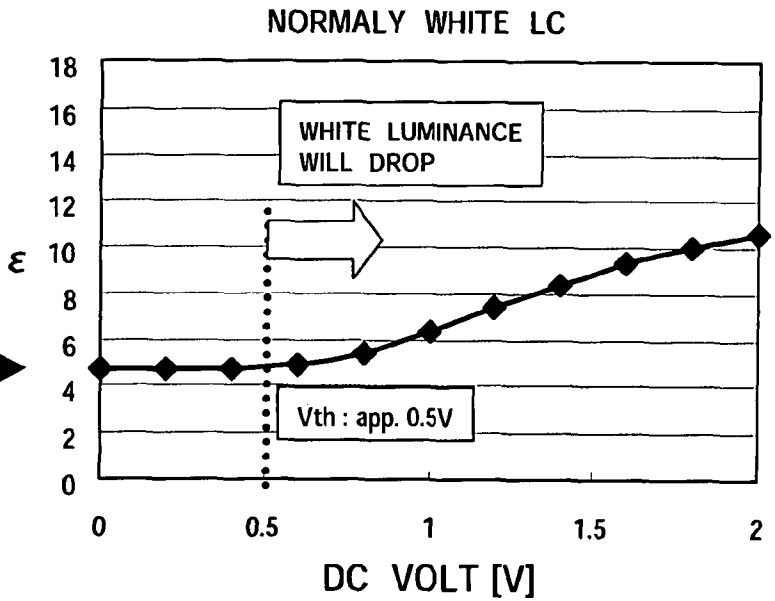

FIGS. 23A and 23B are diagrams for explaining the selection criteria of the effective pixel potential ΔVpix_W applied to the liquid crystals at the time of white display in the case of using a liquid crystal material (normally white liquid crystal) used in liquid crystal display devices. FIG. 23A is a diagram showing the characteristic of the dielectric constant ∈ with respect to the applied voltage, while FIG. 23B is a diagram showing an enlargement of the region where the characteristic of FIG. 23A changes greatly.

As shown in the diagrams, with the characteristic of the liquid crystal used in liquid crystal display devices, the white luminance will drop if a voltage of about 0.5V or more is applied. Therefore, to optimize the white luminance, the effective pixel potential ΔVpix_W applied to the liquid crystal at the time of white display has to be not more than 0.5V. Therefore, the values of the ΔVcs and the ΔVcom are determined so that the effective pixel potential ΔVpix_W becomes no more than 0.5V.

As actually evaluated results, the optimum contrast was obtained at the time of ΔVcs=3.8V and ΔVcom=0.5V.

Figure 24:
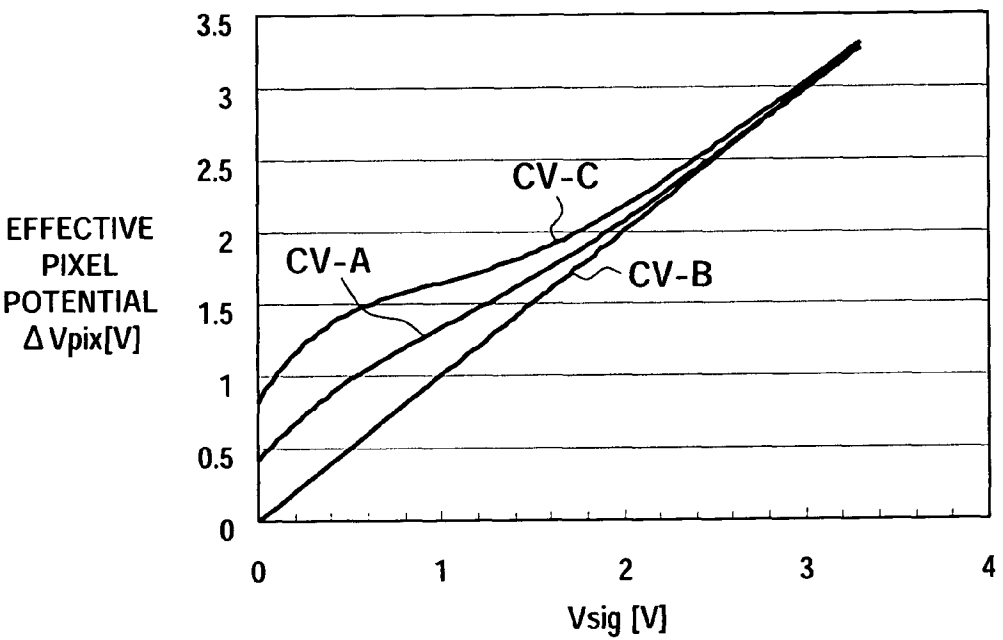
FIG. 24 is a graph showing the relationship of the effective pixel potential and the video signal voltage of the drive system according to an embodiment of the present invention, the related capacity coupling drive system, and the ordinary 1H Vcom drive system.

FIG. 24 is a graph showing the relationship of the video signal voltage and effective pixel potential of a drive system according to an embodiment of the present invention, the related capacity coupling drive system, and an ordinary 1H Vcom drive system. In FIG. 24, the abscissa shows the video signal voltage Vsig, and the ordinate shows the effective pixel potential ΔVpix. Further, in FIG. 24, the line shown by A shows the characteristic of a drive system according to an embodiment of the present invention, the line shown by B shows the characteristic of the related capacity coupling drive system, and the line shown by C shows the characteristic of the ordinary 1H Vcom drive system.

As will be understood from FIG. 24, according to the drive system of the present embodiment, a sufficient improvement of the characteristic is obtained in comparison to the related capacity coupling drive system.

Figure 25:
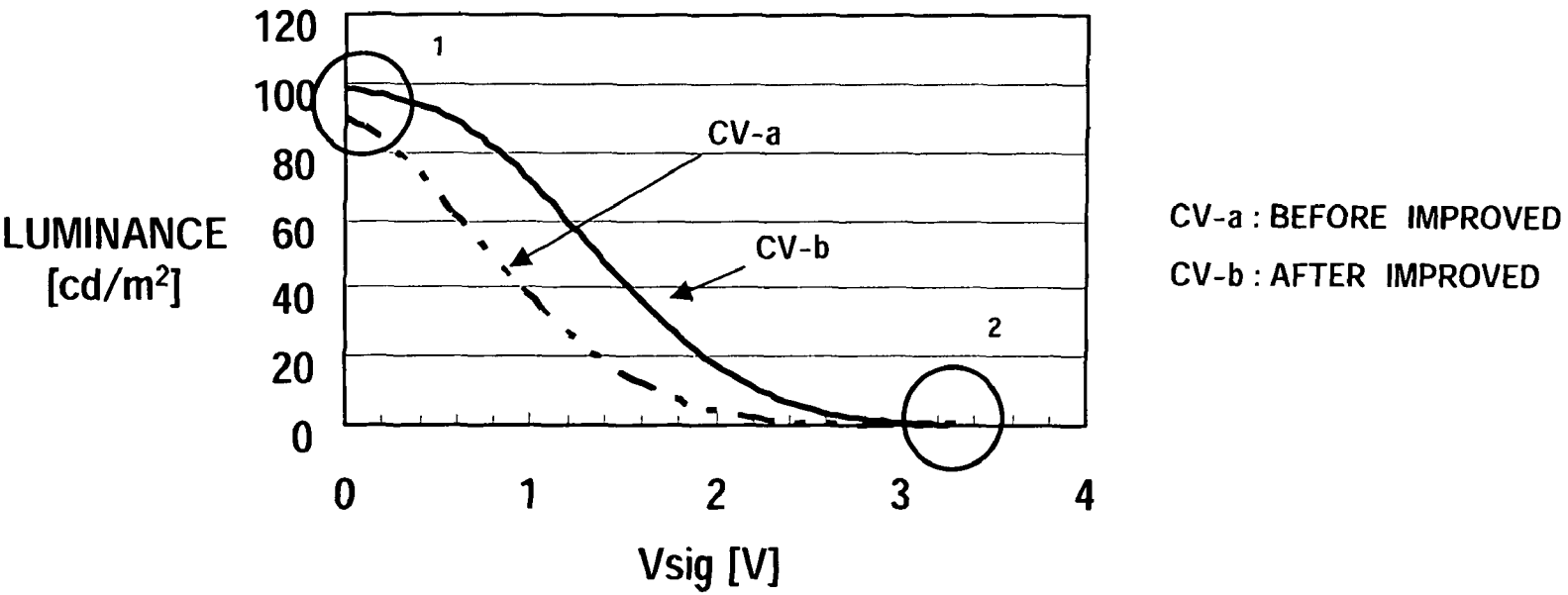
FIG. 25 is a graph showing the relationship of the video signal voltage and luminance of the drive system according to an embodiment of the present invention and the related capacity coupling drive system.

FIG. 25 is a graph showing the relationship of the video signal voltage and luminance of the drive system according to an embodiment of the present invention and the related capacity coupling drive system. In FIG. 25, the abscissa shows the video signal voltage Vsig, and the ordinate shows the luminance. Further, in FIG. 25, the line shown by CV-A shows the characteristic of the drive system according to an embodiment of the present invention, and the line shown by CV-B shows the characteristic of the related capacity coupling drive system.

As shown by FIG. 25, when optimizing the black luminance (2) in the related capacity coupling drive system, the white luminance (1) dropped. As opposed to this, according to the drive system of the present embodiment, by making the Vcom a small amplitude, the black luminance (1) and white luminance (1) can both be optimized.

The following equation (4) shows the values of the effective pixel potential ΔVpix_B at the time of black display and the effective pixel potential ΔVpix_W at the time of white display at the time of black display in the case of setting specific numerical values in equation (3) in the drive system according to the present embodiment. Further, it shows the values of the effective pixel potential ΔVpix_B at the time of black display and the effective pixel potential ΔVpix_W at the time of black display in the case of setting specific numerical values in equation (1) of the capacity coupling drive system relating to equation (5).

(1) At time of black display $$\Delta\text{Vpix_B} = Vsig + \frac{Ccs}{Clc\ b + Ccs} \times \Delta Vcs + \frac{Clc\ b}{Clc\ b + Ccs} \times \frac{\Delta Vcom}{2} - Vcom = 3.3\ \text{V} + 1.65 - 1.65\ \text{V} = 3.3\ \text{V (Optimization of the black luminance)}$$

(2) At time of white display $$\Delta\text{Vpix_W} = Vsig + \frac{Ccs}{\text{Clc_w} + Ccs} \times \Delta Vcs + \frac{Clc\ w}{\text{Clc_w} + Ccs} \times \frac{\Delta Vcom}{2} - Vcom = 0.0\ \text{V} + 2.05 - 1.65\ \text{V} \quad (4)$$

-continued $$= 0.4\ \text{V (Optimization of the white luminance)}$$

$$\Delta\text{Vpix_B} = Vsig + \frac{Ccs}{\text{Clc_b} + Ccs} \times \Delta Vcs - Vcom$$

$$= 3.3\ \text{V} + 1.65 - 1.65\ \text{V}$$

$$= 3.3\ \text{V (Optimization of the white luminance)}$$

(2) time of white display $$\Delta\text{Vpix_W} = Vsig + \frac{Ccs}{\text{Clc_w} + Ccs} \times \Delta Vcs - Vcom \quad (5)$$

$$= 0.0\ \text{V} + 2.45 - 1.65\ \text{V}$$

$$= 0.8\ \text{V (White luminance sinks)}$$

As shown in equation (4) and equation (5), at the time of black display, the effective pixel potential ΔVpix_B becomes 3.3V and the black luminance is optimized in both the drive system according to the present embodiment and the related drive system. At the time of white display, as shown in equation (5), the effective pixel potential ΔVpix_W of the related drive system becomes a value more than 0.5V, that is, 0.8V, so the white luminance drops as explained with reference to FIG. 23B. As opposed to this, the effective pixel potential ΔVpix_W of the drive system according to the present embodiment becomes a value less than 0.5V, that is, 0.4V, so the white luminance is optimized as explained with reference to FIG. 23B.

Next, a specific example of the configuration of correcting the storage signal CS taking into account the optical characteristics so that the pixel potential detected from the dummy pixel section 108 by the detection circuit 109 becomes a desired potential, which is one characteristic feature of the present embodiment, will be explained.

In the present embodiment, changes in the drive temperature cause the dielectric constant and refractive index of the insulating film and liquid crystals forming the storage capacitor CS201 to fluctuate and cause the voltage applied to the liquid crystals to fluctuate. The embodiment therefore electrically detects the amounts of fluctuation of the dielectric constant and refractive index of the liquid crystals due to this temperature change and suppresses the fluctuation of the voltage applied to the liquid crystals so as to suppress changes in the display due to temperature.

Figure 26:
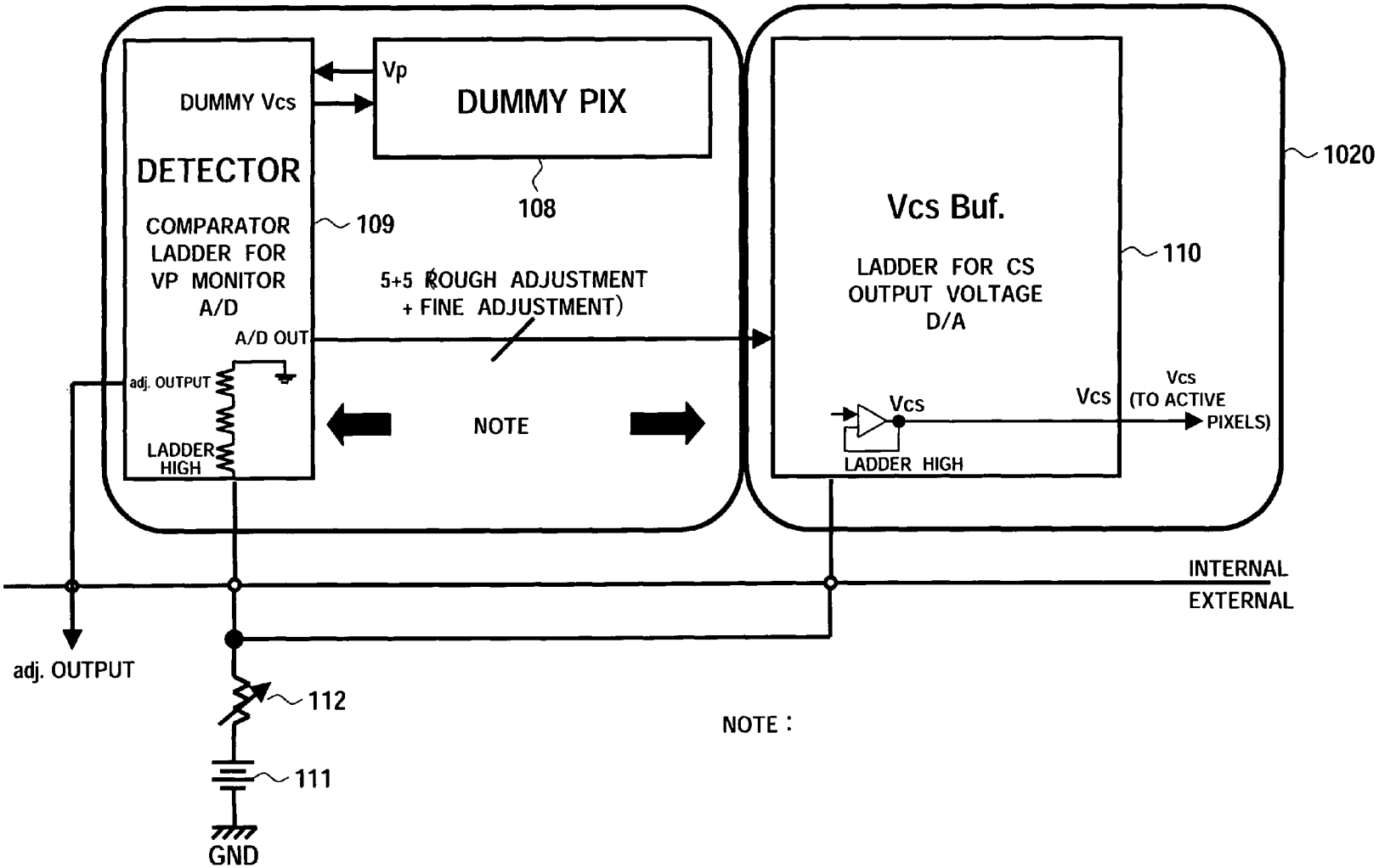
FIG. 26 is a diagram showing the basic configuration of a correction circuit system according to the present embodiment.

FIG. 26 is a diagram showing the basic configuration of a correction circuit system according to the present embodiment. The correction circuit system 300 has as its main constituent elements a dummy pixel section 108 detecting the pixel potential, a detection circuit 109 performing rough adjustment and fine adjustment based on the detected pixel potential and detecting the optimum voltage for correction, a CS buffer 110 receiving the optimum voltage from the detection circuit 109 and applying a storage signal CS1 taking into account the optical characteristics to the corresponding storage lines 106-1 to **106-*m*, a power source 111, and a calibration variable resistance 112** attached outside for absorbing the amount of fluctuation.

Figure 27:
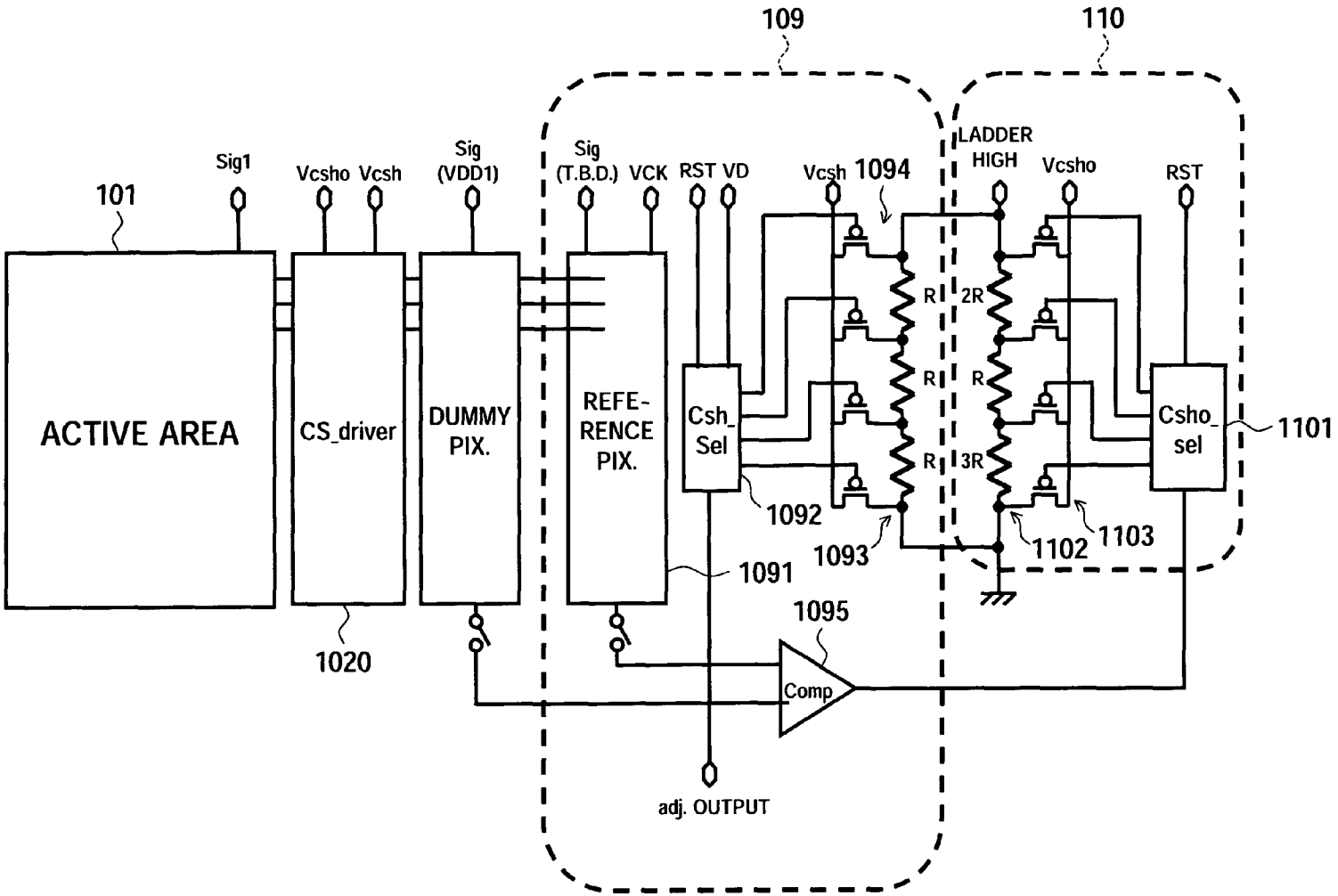
FIG. 27 is a circuit diagram showing a more detailed configuration of the correction circuit system according to the present embodiment.

FIG. 27 is a circuit diagram showing the more detailed configuration of the correction circuit system according to the present embodiment.

The detection circuit 109 has conceptually a reference pixel section 1091, a memory 1092, a ladder resistance section 1093, a group of switches (PMOS) 1094 connected to divided terminals of the ladder resistance 1093 part, and a comparator 1095. Further, the CS buffer 110 of the CS driver 1020 has a memory 1101, a ladder resistance section 1102 forming weighted resistances in a ladder form, and a group of switches (PMOS) 1103 connecting to the divided terminals of the ladder resistance section 1102.

Figures 28A, 28B:
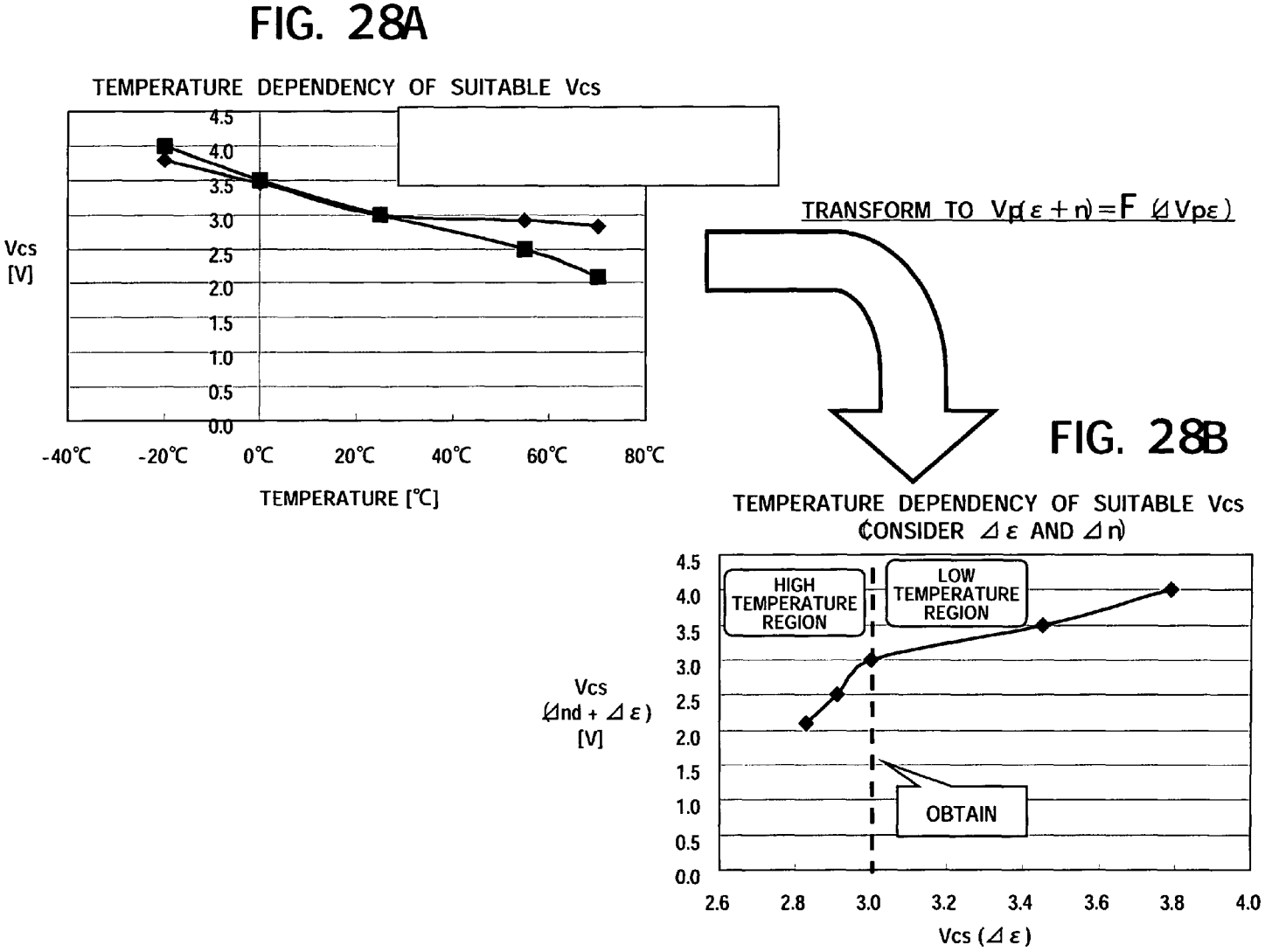
FIGS. 28A and 28B are diagrams explaining an example of settings of the weighting values of a ladder resistance section.

The resistance weighting of the ladder resistance section 1102 is performed as follows. As shown in FIGS. 28A and 28B, the optical characteristics of the dielectric constant ∈ and refractive index n of the liquid crystals are considered. A boundary is drawn at the ordinary (normal) temperature of 25° C. The degree of weighting is changed taking into consideration the characteristic curve of the storage signal taking into consideration the optical characteristics of the dielectric constant ∈ and the refractive index n of the liquid crystals of the storage signal Vcs in the high temperature region and the low temperature region from ordinary temperature. In the present embodiment, the curve is sharper in angle in the high temperature region compared with the low temperature region, so the weighting value of the high temperature region is made greater than the weighting value of the low temperature region (the weighting is made heavier). In the example of FIG. 27, while conceptual, in the ladder resistance section, the resistance corresponding to the high temperature region is set to three times the ordinary resistance value R, that is, to 3R, and the resistance corresponding to the low temperature region is set to two times the ordinary resistance, that is, to 2R.

Note that the memory 1101 is set with, as an initial value, a voltage value serving as a basis when comparing the pixel potential of the dummy pixel section 108 and the pixel potential of the reference pixel section 1091 by the comparator 1095 by time division.

Figure 29:
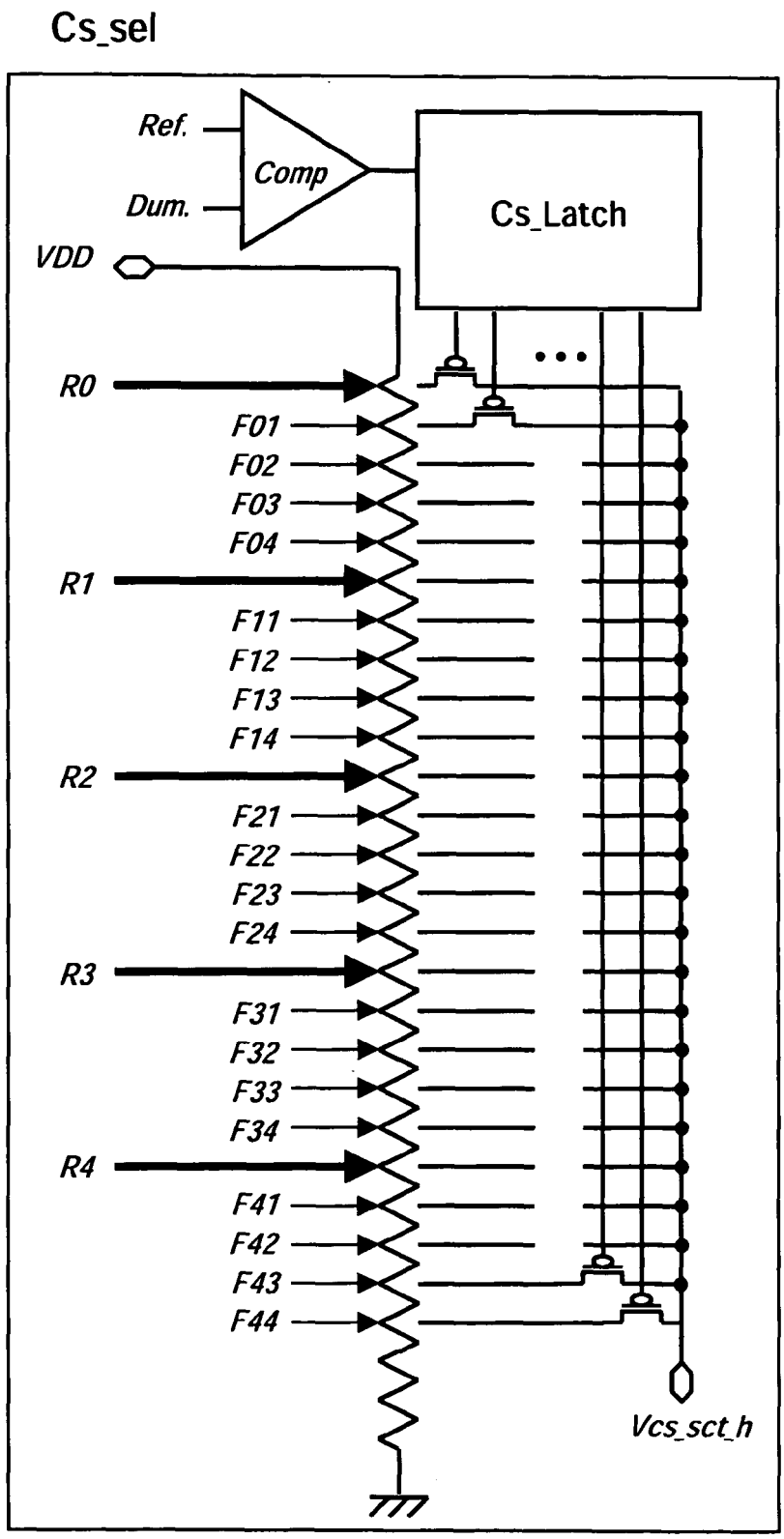
FIG. 29 is a circuit diagram conceptually showing the search operation of the optimum voltage value by rough adjustment and fine adjustment.
Figure 30:
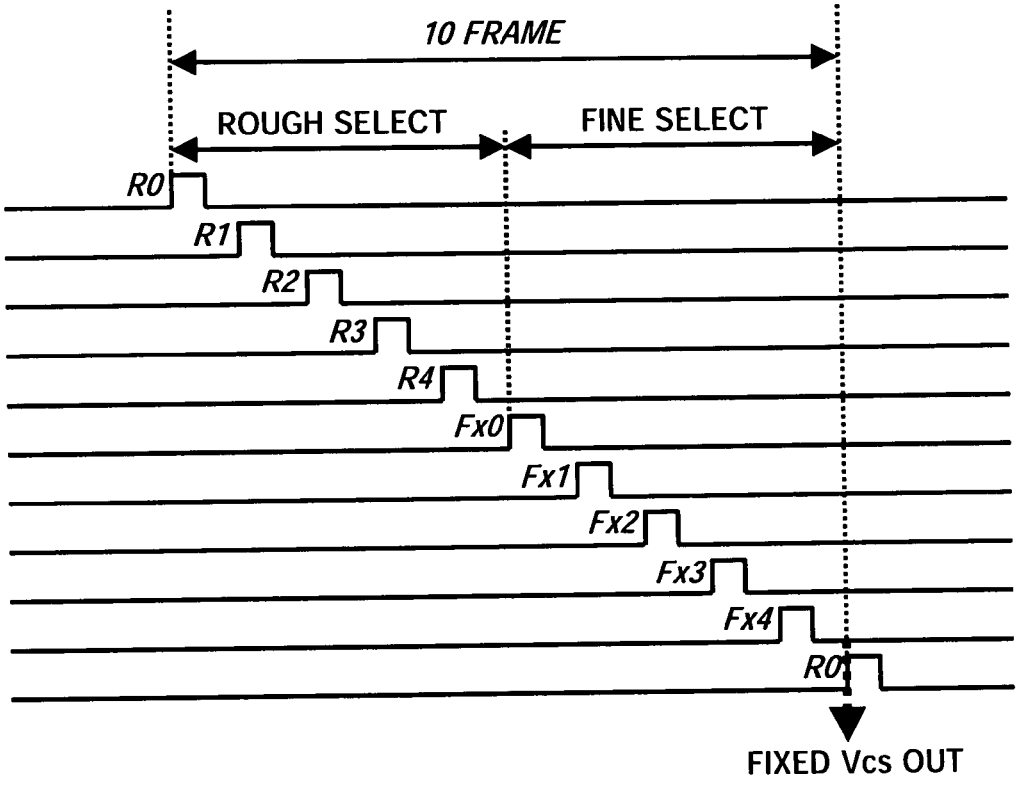
FIG. 30 is a timing chart conceptually showing the search operation of the optimum voltage value by rough adjustment and fine adjustment.

FIG. 29 and FIG. 30 are diagrams showing conceptually the operation for searching for the optimum voltage value by rough adjustment and fine adjustment. FIG. 29 shows a circuit diagram and FIG. 30 shows a timing chart.

The rough adjustment is performed by the five R0 to R4 in the first half of for example 10 frames, while the fine adjustment is performed as shown by the five F×0 to F×4 in the latter half. In this way, the optimum Vcs value (1/25) is selected and output in a 10 frame period.

Figure 31:
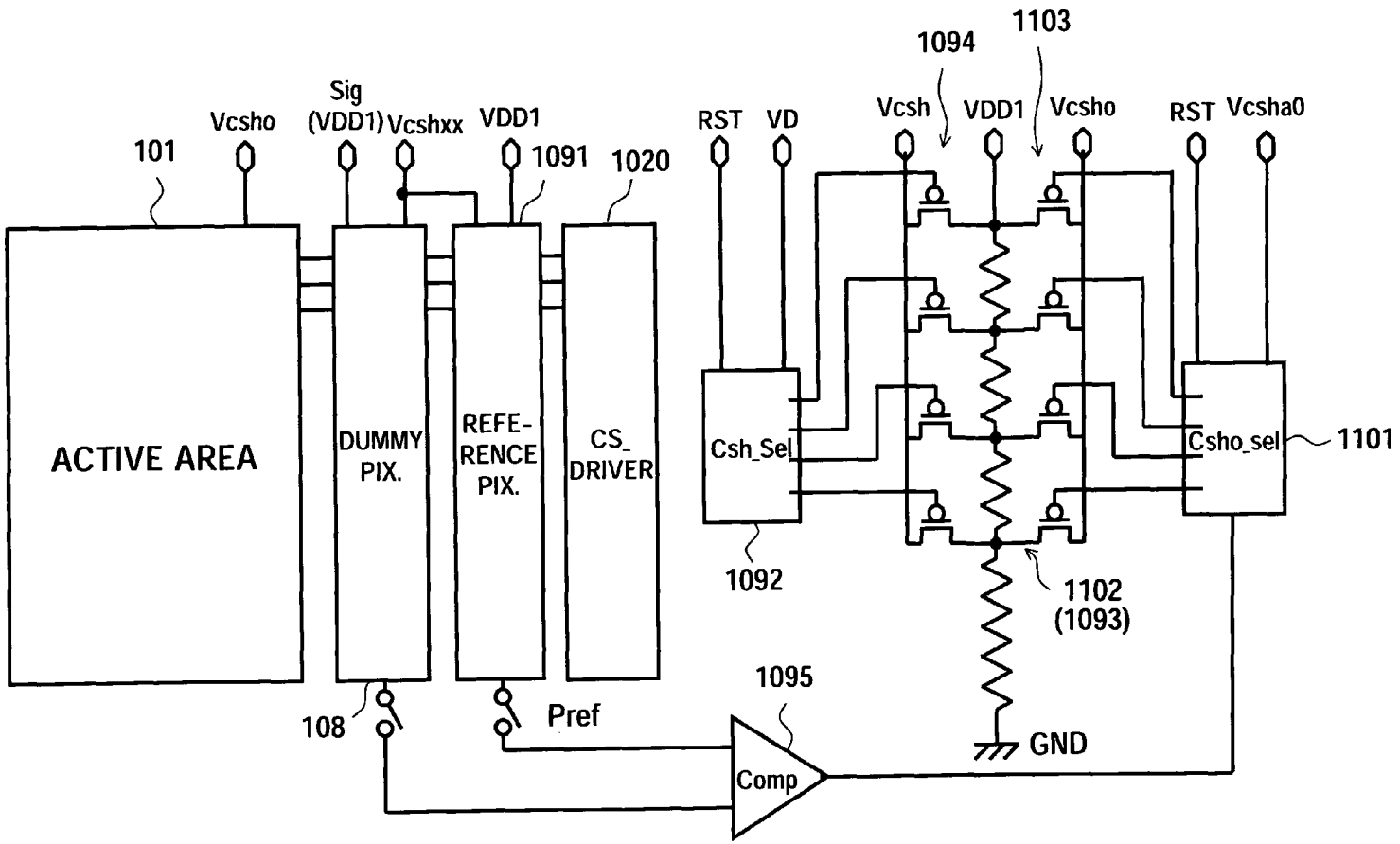
FIG. 31 is a circuit diagram showing a preferable example of the configuration of the correction circuit system.

Note that FIG. 26 and FIG. 27 display conceptual parts, however, for example, as shown in FIG. 31, the detection circuit 109 and the CS buffer 110 may be configured so as to share the ladder resistance section.

Figure 32A:
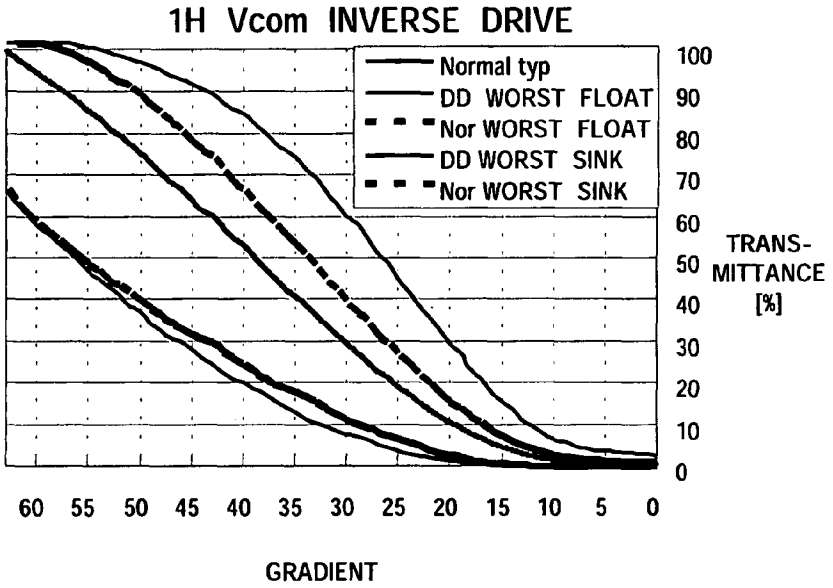
FIG. 32 is a diagram showing the relationship of the input shade and the transmittance of the 1H Vcom inversion drive system and the relationship of the input shade and the transmittance of the drive system of the present embodiment taking into account the optical characteristics.
Figure 32B:
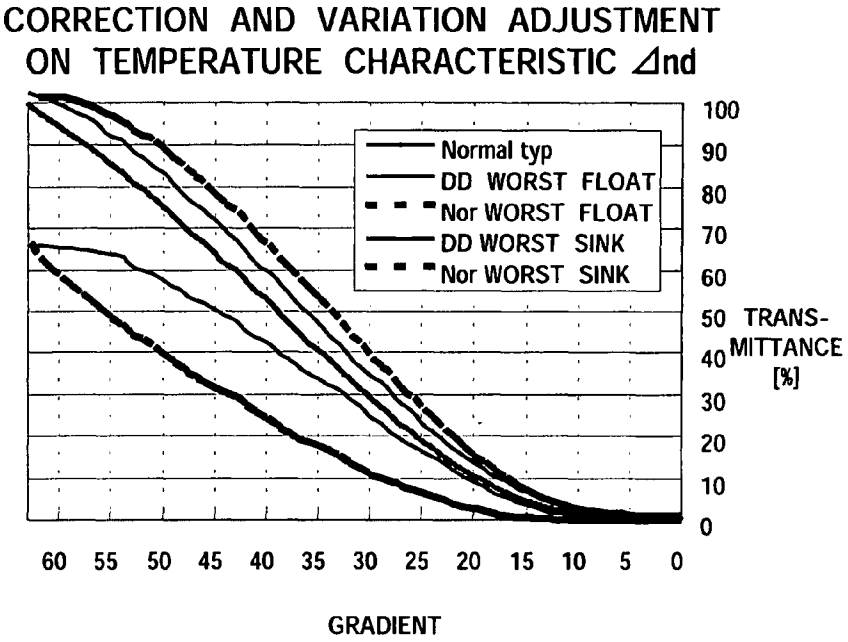

FIG. 32A is a graph showing the relationship of the input shade and the transmittance of the 1H Vcom inversion drive system, while FIG. 32B is a graph showing the relationship of the input shade and transmittance of the drive system of the present embodiment taking into account the optical characteristics.

In the case of the 1H Vcom inversion drive system, there is a large variation in the transmittance characteristic at the high temperature side, however, in the case of the drive system of the present embodiment taking into account the optical characteristics, there variation can be suppressed.

Next, the operation by the above configuration will be explained.

A shift register of the vertical drive circuit 102 is supplied with a vertical start pulse VST instructing the start of the vertical scan and the vertical clocks VCK and VCKX with opposite phases serving as the criteria of the vertical scan generated by a not shown clock generator. The shift register performs a level shift operation on the vertical clocks and delays them by differing delay times. For example, in the shift register, the vertical start pulse VST is shifted synchronized with the vertical clock VCK and supplied to the corresponding gate buffer. Further, the vertical start pulse VST is propagated from the top or bottom of the effective pixel section 101 and is successively shifted to the shift registers. Therefore, basically, the gate lines 105-1 to **105-*m*** are driven in sequence through the gate buffers by the vertical clocks supplied by the shift register VSR.

In this way, the vertical drive circuit 102 drives the gate lines 105-1 to **105-*m* in sequence for example from the first row. Along with this, the storage lines 106-1 to 106-*m* are driven. At this time, one gate line is driven by the gate pulse, then the levels of the storage signals CS1 to CSm applied to the storage lines 106-1 to 106-*m* at the timing of the rising edge of the gate pulse of the next gate line are selected alternately and applied at the first level CSH and the second level CSL. For example, in the case where the first level CSH is selected and the storage signal CS1 is applied to the storage line 106-1 of the first row, the second level CSL is selected and the storage signal CS2 is applied to the storage line 106-2 of the second row, the first level CSH is selected and the storage signal CS3 is applied in the storage line 106-3 of the third row, and the second level CSL is selected and the storage signal CS4 is applied in the storage line 106-4 of the fourth row. In the same way below, the first level CSH and the second level CSL are alternately selected and the storage signals CS5 to CSm are applied to the storage lines 106-5 to 106-*m*. The storage signal is therefore corrected taking into account the optical characteristics so as to give the desired potential based on the potential of the dummy pixel section 108 detected by the detection circuit 109**.

Further, the alternate common voltage Vcom of the small amplitude ΔVcom is applied in common to the second pixel electrodes of the liquid crystal cells LC201 of all the pixel circuits PXLC of the effective pixel section 101.

Further, the horizontal drive circuit 103 receives a horizontal start pulse HST instructing the start of a horizontal scan and horizontal clocks HCK and HCKX with opposite phases serving as the reference for the horizontal scan generated by a not shown clock generator, generates a sampling pulse, successively samples the input video signal in response to the generated sample pulse, and supplies the results to the signal line 107-1 to **107-*n*** as data signals SDT to be written in the pixel circuits PXLC. For example, first, the R-use selector switch is controlled to the conductive state and the R data is output to the signal lines and written. When the write operation of the R data ends, only the G-use selector switch is controlled to the conductive state and the G data is output to the signal lines and written. When the write operation of the G data ends, only the B-use selector switch is controlled to the conductive state and the B data is output to the signal lines and written.

In the present embodiment, after the write operation from this signal line (after the trailing edge of the gate pulse GP), the pixel potential (the potential of the node ND201) is changed by coupling through the storage capacitor CS201 from the storage lines 106-1 to **106-*m***, and the voltage applied to the liquid crystal is modulated. At this time, the common voltage Vcom is supplied as an alternate signal by a small amplitude (10 mV to 1.0V) and not as a constant value. By this, not only the black luminance but also the white luminance is optimized.

As explained above, the present embodiment has a effective pixel section 101 comprised of a plurality of pixel circuits PXLC, each writing video pixel data through a TFT 201, arrayed in a matrix, gate lines 105-1 to **105-*m* positioned so as to correspond to the array of rows of the pixel circuit, a plurality of capacity lines 106-1 to 106-*m* positioned so as to correspond to the array of rows of the pixel circuit, signal lines 107-1 to 107-*m* positioned so as to correspond to the array of columns of the pixel circuit, a vertical drive circuit 102 selectively driving the gate lines and capacity lines, and a generation circuit 104 generating a common voltage signal of a small amplitude which switches in the level at a predetermined cycle, each pixel circuit containing liquid crystal cell LC201 having a first pixel electrode and second pixel electrode and a storage capacitor CS201** having a first electrode and second electrode. The first pixel electrode of the liquid crystal cell, the first electrode of the storage capacitor, and one terminal of the TFT are connected. A second electrode of the storage capacitor is connected to the capacity line arrayed in the corresponding row. The common voltage signal is applied to the second pixel electrode of the liquid crystal cell. Therefore, both black luminance and white luminance can be optimized. As a result, there is the advantage of being able to optimize the contrast.

Further, in the present embodiment, changes in the drive temperature cause the dielectric constant and refractive index of the insulating film and liquid crystals forming the storage capacitor CS201 to fluctuate and cause the voltage applied to the liquid crystals to fluctuate. The embodiment therefore electrically detects the amounts of fluctuation of the dielectric constant and refractive index of the liquid crystals due to this temperature change and suppresses the fluctuation of the voltage applied to the liquid crystals so as to suppress changes in the display due to temperature.

Further, the CS driver in the vertical drive circuit 102 of the present embodiment is not dependent on the surrounding drive stages or the polarity of the previous frame and determines the polarity of the CS signal only by the polarity (shown by POL) of the time of a pixel write operation. That is, it does not depend on the signal of the surrounding stages in the present embodiment and is controllable by only a signal of its own stage. Further, the CS blocks etc. of the vertical drive circuit of the present embodiment can be formed by small numbers of elements and therefore contribute to the reduction of circuit size. For example, they may be configured by 20 or less transistors.

Note that in the above embodiment, the explanation was given of the case of application of the invention to a liquid crystal display device mounting an analog interface drive circuit receiving as input an analog video signal, latching this, then successively writing the analog video signal in the pixels in points, but the invention can be similarly applied to a liquid crystal display device mounting a drive circuit receiving as input a digital video signal and writing the video signal in the pixels in lines by the selector system.

Further, in the above embodiment, the explanation was given of the case of application of the invention to an active matrix-type liquid crystal display device using liquid crystal cells as the display elements (electrooptic elements) of the pixels, but to invention is not limited to a liquid crystal display device. It may also be applied generally to active matrix type display devices such as active matrix type electroluminescence (EL) display devices using EL elements as the display element of the pixels. The display device according to the embodiment explained above can also be used for display panels of direct viewing type video display devices (liquid crystal monitors and liquid crystal viewfinders) and projection type liquid crystal display devices (liquid crystal projectors), that is, liquid crystal display (LCD) panels.

It should be understood by those skilled in the art that various modifications, combinations, sub-combinations, and alterations may occur depending on design requirements and other factors insofar as they are within the scope of the appended claims or the equivalents thereof.

What we claim is:

1. A display device comprising:

a pixel section having a plurality of pixel circuits, each writing video pixel data propagated through a switching element over a signal line, arranged in a matrix, a plurality of scan lines arranged so as to correspond to an array of rows of the pixel circuits and control conduction of the switching elements, a plurality of capacity lines arranged so as to correspond to an array of rows of the pixel circuits, a drive circuit for selectively driving the plurality of scan lines and the plurality of capacity lines, a generation circuit for generating a common voltage signal switched in level at a predetermined cycle, and a correction circuit for correcting the signals driving the capacity lines of the drive circuit, wherein each pixel circuit arrayed at the pixel section includes a display element having a first pixel electrode and second pixel electrode and a holding capacitor having a first electrode and second electrode, a first pixel electrode of the display element pixel cell and a first electrode of the holding capacitor are connected to one terminal of the switching element, a second electrode of the holding capacitor is connected to the capacity line arrayed at a corresponding row, a second pixel electrode of the display element is supplied with the common voltage signal, the drive circuit has a capacity line driver which drives a corresponding capacity line independently for each row based on a polarity signal at the time of a pixel write operation wherein values for corrected signals driving the capacity lines are determined at least in part based upon a predetermined temperature relationship; and further wherein the common voltage signal is a small amplitude signal;

the drive circuit has a capacity line driver which determines a polarity of a signal driving a capacity line based on the polarity at the time of a pixel write operation;

the drive circuit has a scan line driver including a shift register for shifting a predetermined signal in a column direction and a buffer receiving the signal of the shift register and driving the corresponding scan line, and the capacity line driver includes a first latch latching the polarity signal based on an output signal of the shift register to the buffer and a second latch latching and outputting the polarity signal latched by the first latch based on a shift signal to a next stage of the shift register.

2. A display device as set forth in claim 1, wherein the drive circuit drives the scan lines of the selected row, writes pixel data into the desired pixel circuits, then drives the capacity lines of the same row.

3. A display device as set forth in claim 1, wherein the drive circuit selects as a signal for driving a capacity line one of a first level and a second level lower than the first level and applies it to the corresponding capacity line.

* * * * *